US008528946B2

(12) United States Patent
Shen

(10) Patent No.: US 8,528,946 B2
(45) Date of Patent: Sep. 10, 2013

(54) DOOR LOCK WITH IDLE TRAVEL IN A LOCKING STATE

(75) Inventor: Chun-Meng Shen, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 223 days.

(21) Appl. No.: 13/170,329

(22) Filed: Jun. 28, 2011

(65) Prior Publication Data

US 2013/0001961 A1 Jan. 3, 2013

(51) Int. Cl.
*E05B 65/10* (2006.01)

(52) U.S. Cl.
USPC ..... 292/92; 292/93; 292/DIG. 65; 70/92

(58) Field of Classification Search
USPC ..... 292/92–94, DIG. 65, 21; 70/92
See application file for complete search history.

(56) References Cited

U.S. PATENT DOCUMENTS 3,614,145 A * 10/1971 Zawadzki ..... 292/92
3,663,047 A * 5/1972 Zawadzki ..... 292/92
3,730,574 A * 5/1973 Zawadzki ..... 292/92
3,854,763 A * 12/1974 Zawadzki et al. ..... 292/201
4,083,590 A * 4/1978 Folger ..... 292/92
4,167,280 A * 9/1979 Godec et al. ..... 292/92
4,796,931 A * 1/1989 Heid ..... 292/92
4,801,163 A * 1/1989 Miller ..... 292/92
5,169,185 A * 12/1992 Slaybaugh et al. ..... 292/92
5,340,171 A * 8/1994 Slaybuagh et al. ..... 292/21
5,412,961 A * 5/1995 Cain et al. ..... 70/92
6,048,000 A * 4/2000 Geringer et al. ..... 292/92
6,779,819 B2 * 8/2004 Surko, Jr. ..... 292/92
6,854,773 B2 * 2/2005 Lin ..... 292/92
7,044,510 B2 * 5/2006 Lin ..... 292/93
7,748,757 B2 * 7/2010 Shen ..... 292/92
7,832,777 B2 * 11/2010 Banks et al. ..... 292/92
7,836,738 B2 * 11/2010 Tien et al. ..... 70/149
8,029,027 B2 * 10/2011 Tien ..... 292/92
8,042,843 B2 * 10/2011 Tien ..... 292/92
8,070,192 B2 * 12/2011 Tien ..... 292/92
8,146,961 B2 * 4/2012 Schacht ..... 292/92
8,182,003 B2 * 5/2012 Dye et al. ..... 292/92
8,201,857 B2 * 6/2012 Tien ..... 292/92
8,267,440 B2 * 9/2012 Shen ..... 292/92
2004/0227353 A1 * 11/2004 Cohrs et al. ..... 292/92
2005/0104381 A1 * 5/2005 Whitaker et al. ..... 292/190
2010/0066102 A1 * 3/2010 Shen ..... 292/92
2012/0256428 A1 * 10/2012 Tien ..... 292/92
2013/0001960 A1 * 1/2013 Tien ..... 292/96

* cited by examiner

*Primary Examiner* — Carlos Lugo
*Assistant Examiner* — Alyson M Merlino
(74) *Attorney, Agent, or Firm* — Alan Kamrath; Kamrath IP Lawfirm, P.A.

(57) ABSTRACT

A door lock (2) includes a linking rod (730) movable in an unlatching direction for moving a latch (38) to an unlatching position and movable in a latching direction for moving the latch (38) to a latching position. When a draw bar (640) is in an extended position and when an operative member (688) is operated, a follower plate (482) and the connecting rod (730) are moved in the unlatching direction through a connecting member (498) and a connecting rod (512). When the draw bar (640) is in a retracted position and when the operative member (688) is operated, the connecting member (498) and the connecting rod (512) are moved in the unlatching direction. Movement of the follower plate (482) in the unlatching direction is stopped by a stop member (668), preventing movement of the linking rod (730) in the unlatching direction and retaining the latch (38) in the latching position.

6 Claims, 25 Drawing Sheets

DOOR LOCK WITH IDLE TRAVEL IN A LOCKING STATE

BACKGROUND OF THE INVENTION

The present invention relates to a door lock and, more particularly, to a door lock mounted on a panic exit door or a passageway door and having an idle travel when the door lock is in a locking state to avoid damage to the components of the door lock.

A typical lock for a panic exit door or a passageway door generally includes a press bar that can be pressed to retract a latch for unlatching the door in emergency conditions as well as for normal passage. When the door lock is in a locking state, the latch can not be retracted to prevent unauthorized access. However, the press bar has a large area and, thus, imparts considerable force and causes damage to the components in the lock if the press bar is pressed with large force while the lock is in the locking state.

Thus, a need exists for a door lock that has an idle travel when the door lock is in a locking state to avoid damage to the components of the door lock.

BRIEF SUMMARY OF THE INVENTION

The present invention solves this need and other problems in the field of preventing damage to components of door locks mounted to panic exit doors or passageway doors by providing a door lock including a bracket adapted to be fixed to a side of a door. The door is adapted to be pivotably mounted to a door frame having a stop. A latch is mounted to the bracket and pivotable about a first axis between an extended, latching position, and a retracted, unlatching position. A follower includes a first end pivotably connected to the latch and a second end spaced from the first end of the follower along a second axis perpendicular to the first axis. A linking rod includes first and second ends spaced along the second axis. The first end of the linking rod is pivotably connected to the second end of the follower. The second end of the linking rod is movable in an unlatching direction along the second axis for moving the latch from the extended, latching position, to the retracted, unlatching position, and movable in a latching direction opposite to the unlatching direction for moving the latch from the retracted, unlatching position, to the extended, latching position. First and second brackets are adapted to be fixed to the side of the door, and each includes a sliding slot extending along a third axis perpendicular to the first and second axes. The second bracket has a spacing to the bracket along the second axis larger than the first bracket. A third bracket is adapted to be fixed to the side of the door and located between the first and second brackets along the second axis.

The door lock further includes first and second traction members each having first, second, and third corners. The third corner of the first traction member is pivotably connected to the first bracket by a first axle about a first pivot axis parallel to a pivot axis of the latch. The third corner of the second traction member is pivotably connected to the second bracket by a second axle about a second pivot axis parallel to the first pivot axis. The door lock further includes first and second follower elements each having first and second pivotal portions. The first pivotal portion of the first follower element is pivotably connected to the first corner of the first traction member. The first pivotal portion of the second follower element is pivotably connected to the first corner of the second traction member. A first pin extends through the sliding slot of the first bracket and the second pivotal portion of the first follower element and defines a third pivot axis parallel to the first pivot axis. A second pin extends through the sliding slot of the second bracket and the second pivotal portion of the second follower element and defines a fourth axis parallel to the first pivot axis. The first follower element drives the first traction member to pivot about the first pivot axis when the first pin moves in the sliding slot of the first bracket along the third axis. The second follower element drives the second traction member to pivot about the second pivot axis when the second pin moves in the sliding slot of the second bracket along the third axis. The first and second pins are pivotably connected to an operative member.

The door lock further includes a connecting member having first and second ends spaced along the second axis and a push slot between the first and second ends. The first end of the connecting member is pivotably mounted to the second corner of the first traction member. The connecting member moves along the second axis when the first traction member pivots about the first pivot axis. A follower plate includes front and rear ends spaced along the second axis and first and second grooves between the front and rear ends. The first groove is located between the second groove and the front end. The second groove is located between the first groove and the rear end. The follower plate further includes an extension extending from an edge of the follower plate and located between the front and rear ends. A stop is formed on the extension. The extension includes an elongated slot spaced from the first groove along the third axis. The front end of the follower plate is removably engaged with the second end of the linking rod. The follower plate is mounted to the connecting member. The second groove of the follower plate is aligned with the push slot of the connecting member. The connecting member is slideable relative to the follower plate along the second axis. A peg extends through the first groove of the follower plate. A sleeve is mounted around the connecting member. A pin extends through the push slot of the connecting member, the second groove of the follower plate, and the sleeve. The peg pushes the connecting member to slide along the second axis when the first traction member pivots about the first pivot axis.

The door lock further includes a connecting rod fixed to the second end of the connecting member. The connecting rod includes a connecting end and a pull end spaced from the connecting end along the second axis. The connecting end of the connecting rod is fixed to the second end of the connecting member. The pull end of the connecting rod is pivotably connected to the second corner of the second traction member. The connecting rod moves along the second axis when the second traction member pivots about the second pivot axis. A stop member includes first and second ends and a pivot hole between the first and second ends. The first end of the stop member faces the stop of the follower plate. A third axle extends through the third bracket and the pivot hole of the stop member and defines a fifth pivot axis parallel to the first pivot axis. The stop member is pivotable about the fifth pivot axis. A draw bar includes a head connected to the second end of the stop member. The draw bar is operable to move along the second axis between an extended position and a retracted position. When in the retracted position, the draw bar has a spacing to the latch larger than that in the extended position. When the draw bar is in the extended position, the first end of the stop member is spaced from the stop of the follower plate. When the draw bar is moved from the extended position to the retracted position, the stop member pivots about the fifth pivot axis to abut the first end of the stop member against the stop of the follower plate.

When the draw bar is in the extended position and when the operative member is operated to move the first and second pins along the third axis towards the door, the first and second follower elements pivot the first and second traction members about the first and second pivot axes. The second corners of the first and second traction members move the connecting member and the connecting rod in the unlatching direction. The connecting member causes the pin to push and move the follower plate in the unlatching direction along the second axis. The connecting rod causes the linking rod to move in the unlatching direction along the second axis, moving the latch from the extended, latching position to the retracted, unlatching position.

When the draw bar is in the retracted position and when the operative member is operated to move the first and second pins along the third axis towards the door, the first and second follower elements pivot the first and second traction members about the first and second pivot axes. The second corners of the first and second traction members move the connecting member and the connecting rod in the unlatching direction. Movement of the follower plate in the unlatching direction is stopped by the first end of the stop member. The first groove of the follower plate allows movement of the peg in the unlatching direction without moving the follower plate. The push slot of the connecting member allows movement of the connecting member in the unlatching direction without moving the pin, preventing movement of the linking rod in the unlatching direction. The latch remains in the extended, latching position.

When the draw bar is in the extended position and when the latch is pressed by the stop on the door frame and pivoted from the extended, latching position to the retracted, unlatching position, the latch moves the follower element in the unlatching direction to move the linking rod in the unlatching direction. The linking rod causes the follower plate to move in the unlatching direction. The peg received in the first groove of the follower plate and the pin received in the second groove of the follower plate are not moved. The elongated slot of the follower plate allows movement of the follower plate relative to the third corner of the first traction member without pivoting the first traction member about the first pivot axis.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
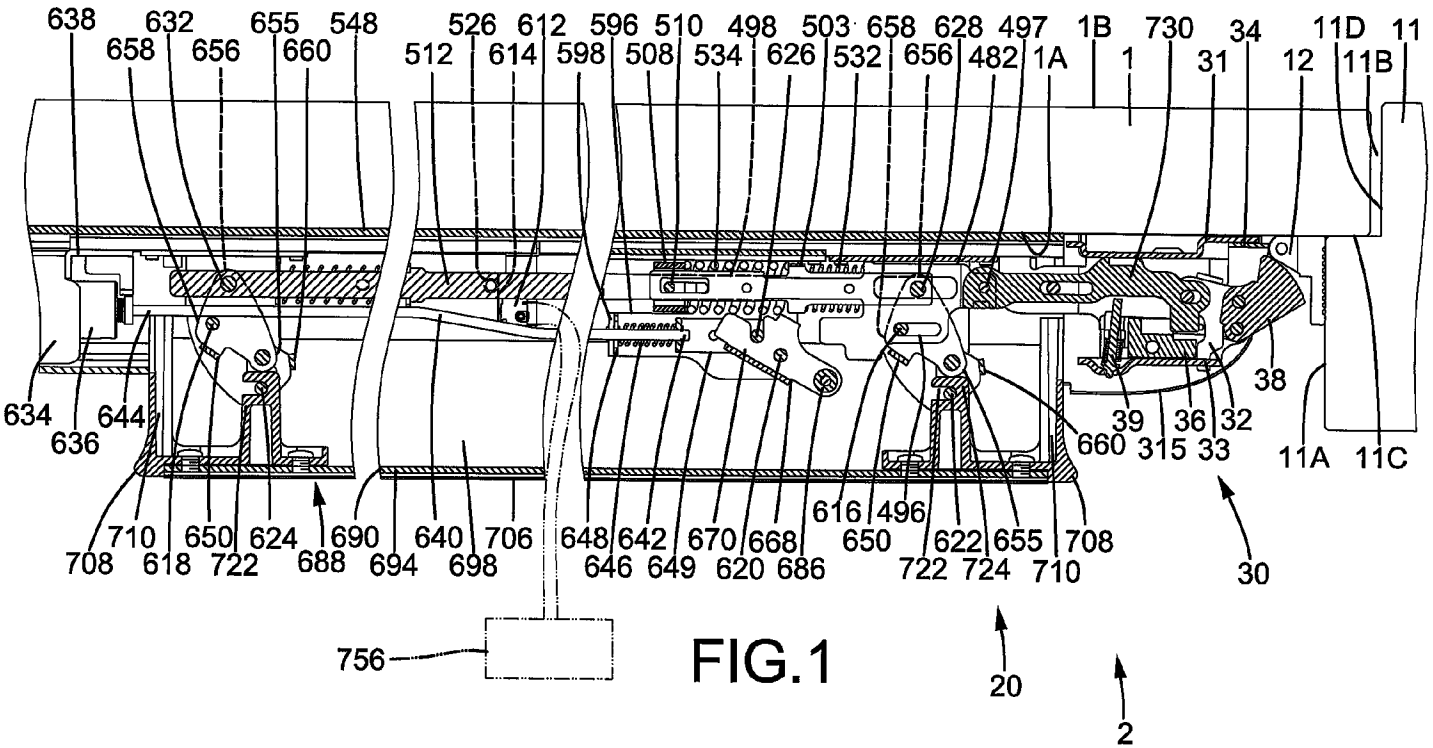
FIG. 1 shows a diagrammatic top view of a door lock according to the present invention and a door to which the door lock is mounted, with the door lock in a locked position and with portions cross sectioned.
Figure 2:
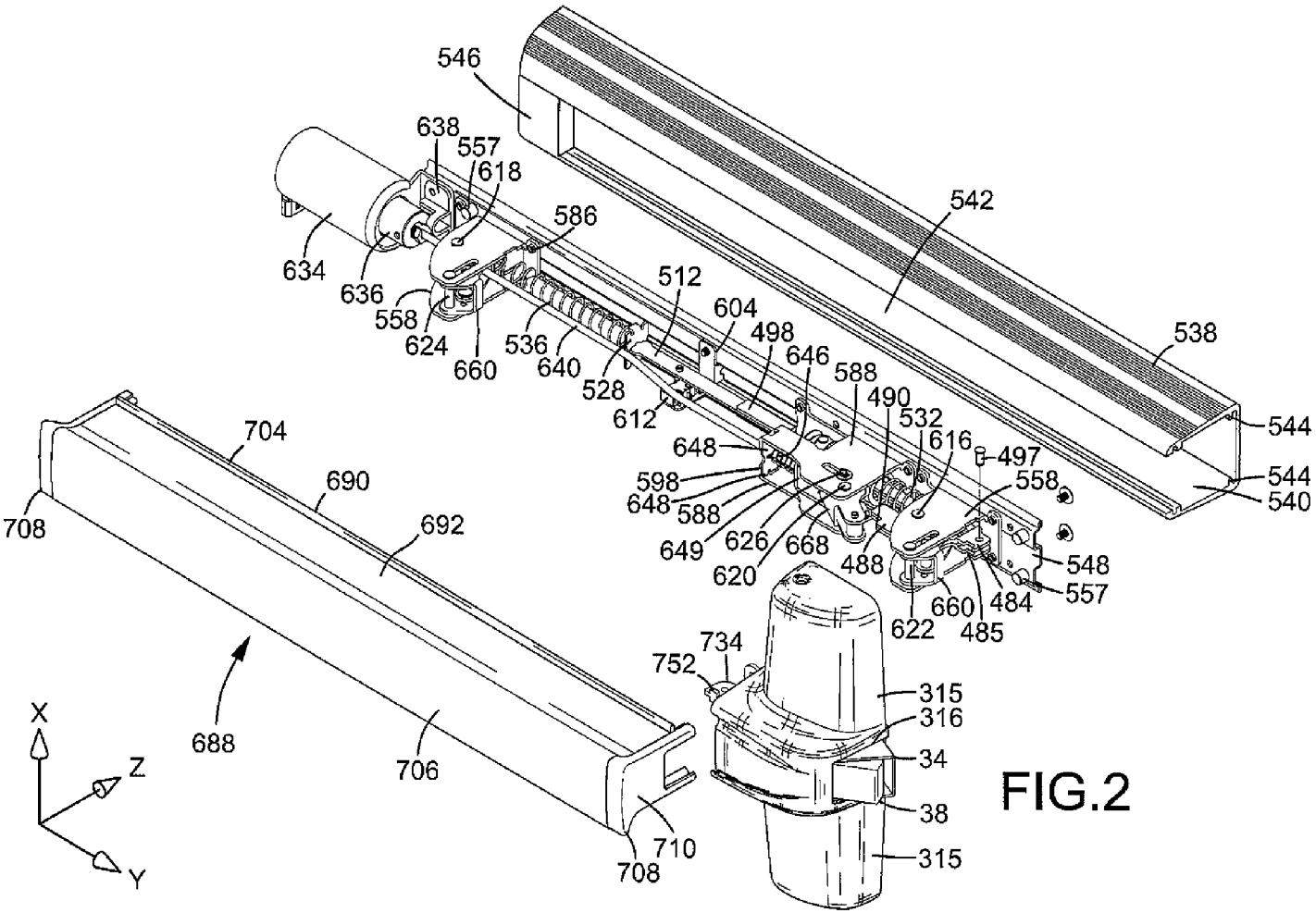
FIG. 2 shows a partial, exploded, perspective view of the door lock of FIG. 1.
Figure 3:
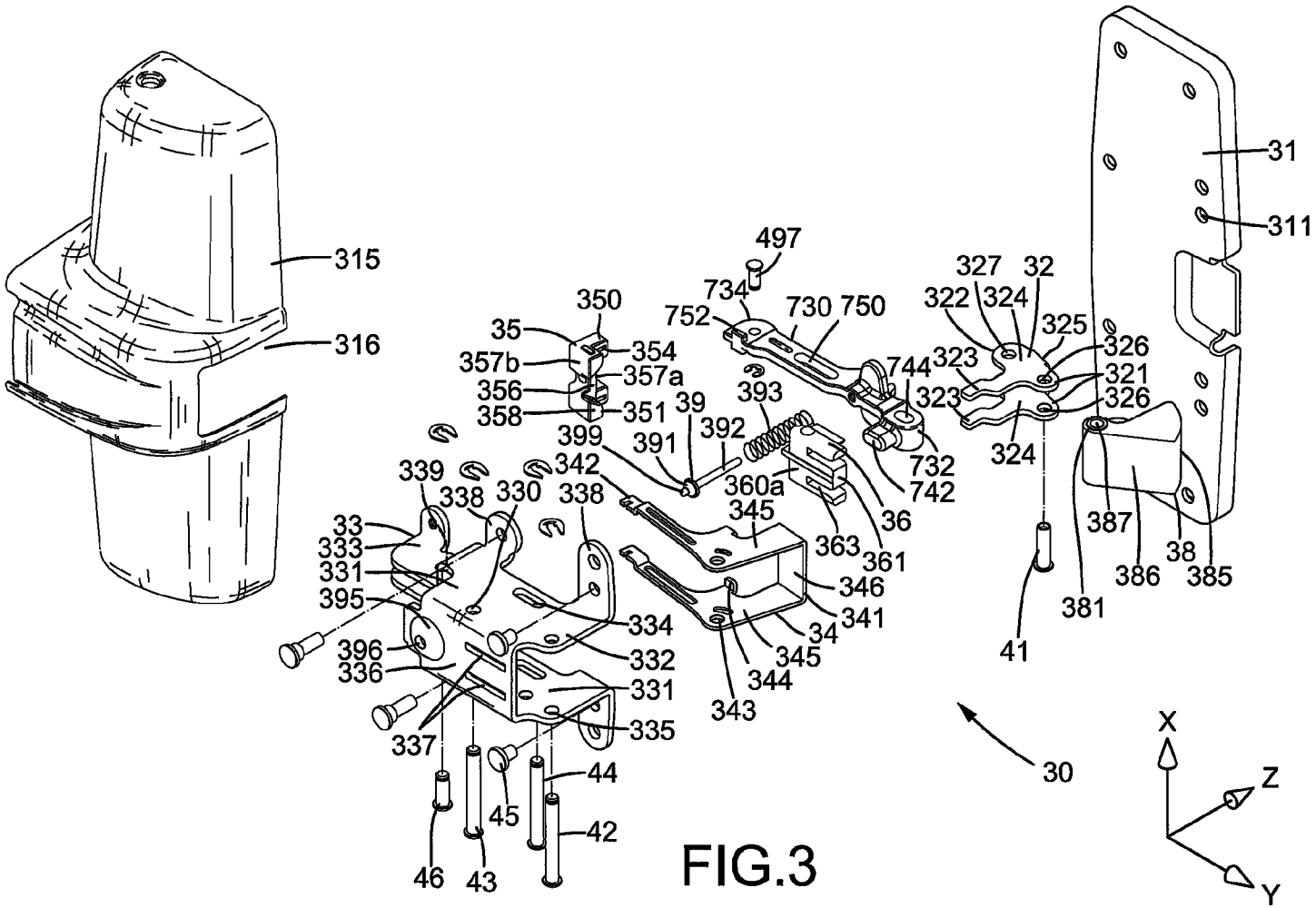
FIG. 3 shows an exploded, perspective view of a latch device of the door lock of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "upper", "lower", "front", "rear", "inner", "outer", "end", "portion", "section", "longitudinal", "lateral", "inward", "leftward", "spacing", "length", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A door lock according to the present invention is shown in the drawings and generally designated 2. Door lock 2 includes an operational device 20 and a latch device 30 mounted to a door 1 pivotable relative to a door frame 11 having rectangular or inverted U-shaped cross sections. Door frame 11 is fixed to a wall of a passageway and includes an inner face 11A and a stepped portion 11B. Stepped portion 11B includes an abutment face 11C extending perpendicularly from an edge of inner face 11A and a face 11D extending perpendicularly to abutment face 11C and parallel to and spaced from inner face 11A. Door 1 includes first and second sides 1A and 1B. An end of door 1 is pivotably mounted to door frame 11, and door 1 is movable between an open position and a closed position. When door 1 is in the closed position, first side 1A of door 1 abuts abutment face 11C of door frame 11. An end face of the other end of door 1 adjacent to stepped portion 11B is spaced from abutment face 11C. A stop 12 is mounted to inner face 11A of door frame 11.

According to the form shown, latch device 30 includes a base 31 fixed to first side 1A of door 1 by fasteners such as screws, bolts, or the like. Base 31 includes a plurality of fixing holes 311. Latch device 30 further includes a bracket 33 having substantially U-shaped cross sections. Bracket 33 includes parallel, spaced first and second sidewalls 331 spaced along a first axis X. Bracket 33 further includes an interconnecting wall 336 interconnected between first and second sidewalls 331 and extending along first axis X. Each of first and second sidewalls 331 has a plurality of engaging portions 338. Fasteners 45 are extended through engaging portions 338 into fixing holes 311 to fix bracket 33 to base 31. Each of first and second sidewalls 331 further includes first and second sections 332 and 333 spaced along a second axis Y perpendicular to first axis X. Aligned pin holes 335 are defined in first sections 332, and aligned holes 339 are defined in second sections 333. First and second sidewalls 331 further include aligned pin holes 330 intermediate holes 339 and pin holes 335. Furthermore, first and second sidewalls 331 include aligned slots 334 intermediate holes 339 and pin holes 335. Interconnecting wall 336 includes two guide slots 337 extending along second axis Y and spaced along first axis X. Interconnecting wall 336 further includes a bulged section 395 spaced from guide slots 337 along second axis Y. Bulged section 395 defines a cavity 397 in an inner face of interconnecting wall 336 and has a hole 396 extending along a third axis Z perpendicular to first and second axes X and Y.

According to the form shown, latch device 30 further includes a latch 38 having triangular cross sections. Specifically, latch 38 includes a first, inner face 382 having first and second ends, a second, arcuate face 385 having a first end interconnected to the first end of first face 382 and a second end, and a third, outer face 386 having first and second ends interconnected to the second ends of the first and second faces 382 and 385. A pivotal portion 381 is formed at a corner between the second end of first face 382 and the first end of third face 386 and includes a pin hole 387 extending along first axis X. A latch pin 42 is extended through pin holes 335 of bracket 33 and pin hole 387 to pivotably connect latch 38 to bracket 33, allowing latch 38 to pivot between an extended, latching position outside bracket 33 (FIGS. 1, 8, and 14A) and a retracted, unlatching position inside bracket 33 (FIGS. 20 and 21) about a pivot axis defined by latch pin 42 extending along first axis X. First face 382 includes a coupling block 383 formed thereon and having a pivot hole 384 adjacent pin hole 387. A cover 315 is mounted to base 31 to enclose latch device 30. Cover 315 includes an opening 316 through which latch 38 is movable.

According to the form shown, a linking rod 730 is mounted between and spaced from first and second sidewalls 331 of bracket 33 along first axis X. Linking rod 730 has first and second ends 732 and 734 spaced along second axis Y. Linking rod 730 further includes upper and lower faces 736 and 738 spaced along first axis X. First end 732 of linking rod 730 includes a slot 744 extending along second axis Y and having a front end 746 and a rear end 748 that is spaced from front end 746 along second axis Y and that has a spacing to first end 732 of linking rod 730 larger than front end 746. Slot 744 extends from upper face 736 through lower face 738 of linking rod 730 and is aligned with slots 334 of brackets 33. A limiting pin 44 is slideably extended through slots 334 of bracket 33 and slot 744 of linking rod 730. Linking rod 730 can move idly along second axis Y without actuating limiting pin 44. The idle travel of linking rod 730 is equal to a length of slot 744 along second axis Y. Specifically, when linking rod 730 is between first and second limit positions of its idle travel along second axis Y relative to limiting pin 44, limiting pin 44 received in slot 744 is not moved. However, when movement of linking rod 730 exceeds the first limit position (FIG. 8) or the second limit position (FIG. 18), the limiting pin 44 is moved along second axis Y together with linking rod 730. First end 732 of linking rod 730 further includes a lateral face 740 extending between and perpendicular to upper and lower faces 736 and 738 of linking rod 730. A protrusion 742 protrudes from lateral face 740 along third axis Z and between upper and lower faces 736 and 738. Second end 734 of linking rod 730 includes an insertion block 752 formed on each of upper and lower faces 736 and 738. Linking rod 730 further includes a limiting slot 750 between slot 744 and insertion blocks 752 and extending along second axis Y. A pin 46 is extended through holes 339 of bracket 33 and limiting slot 750 to assist in stable movement of linking rod 730 along second axis Y between first and second sidewalls 331 of bracket 33. Second end 734 of linking rod 730 further includes a hole 754 extending from upper face 736 through lower face 738.

Figure 14:
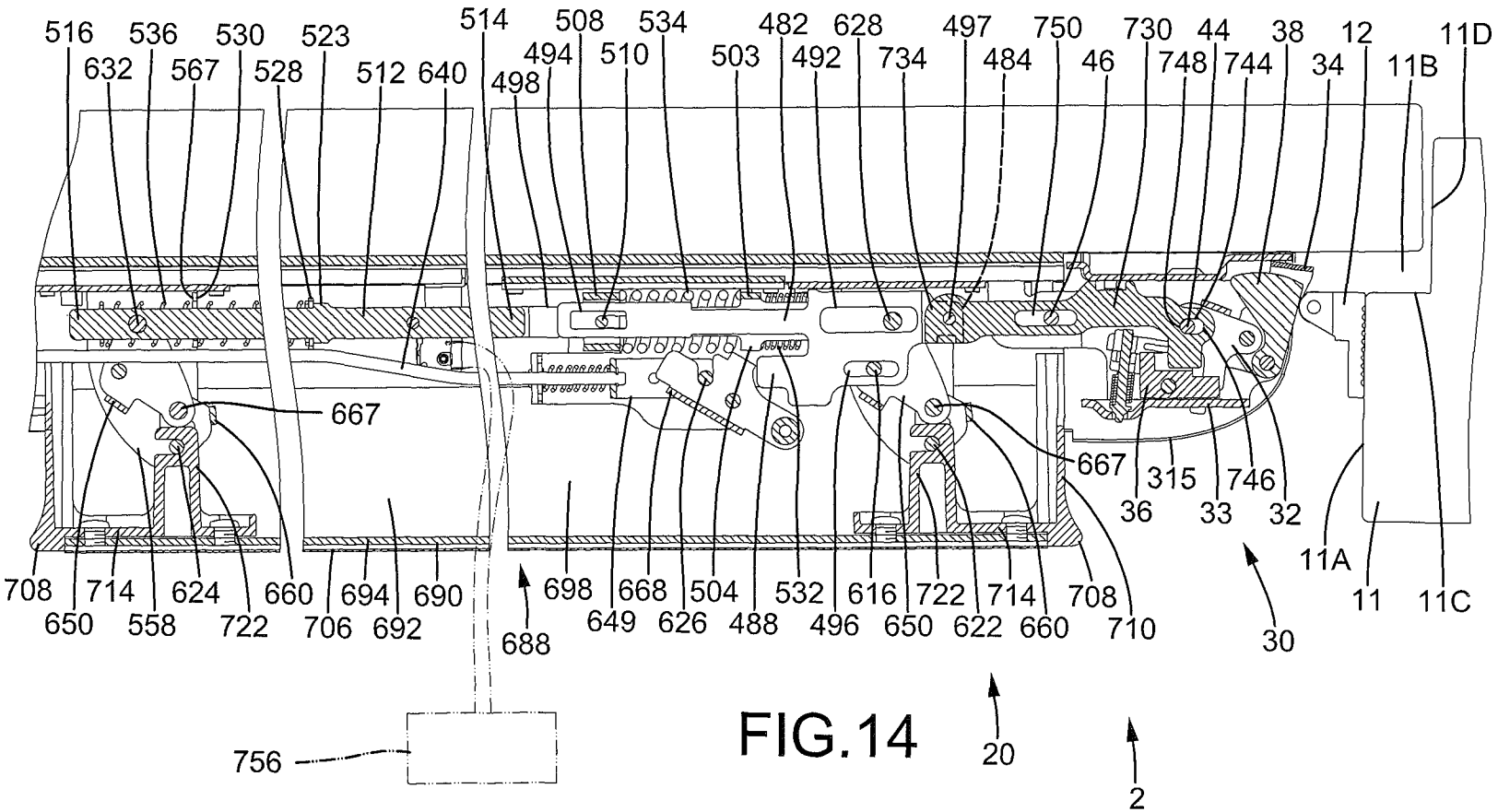
FIG. 14 shows a partial, cross sectional view of the door and the door lock of FIG. 1, illustrating closing of the door.
Figure 14A:
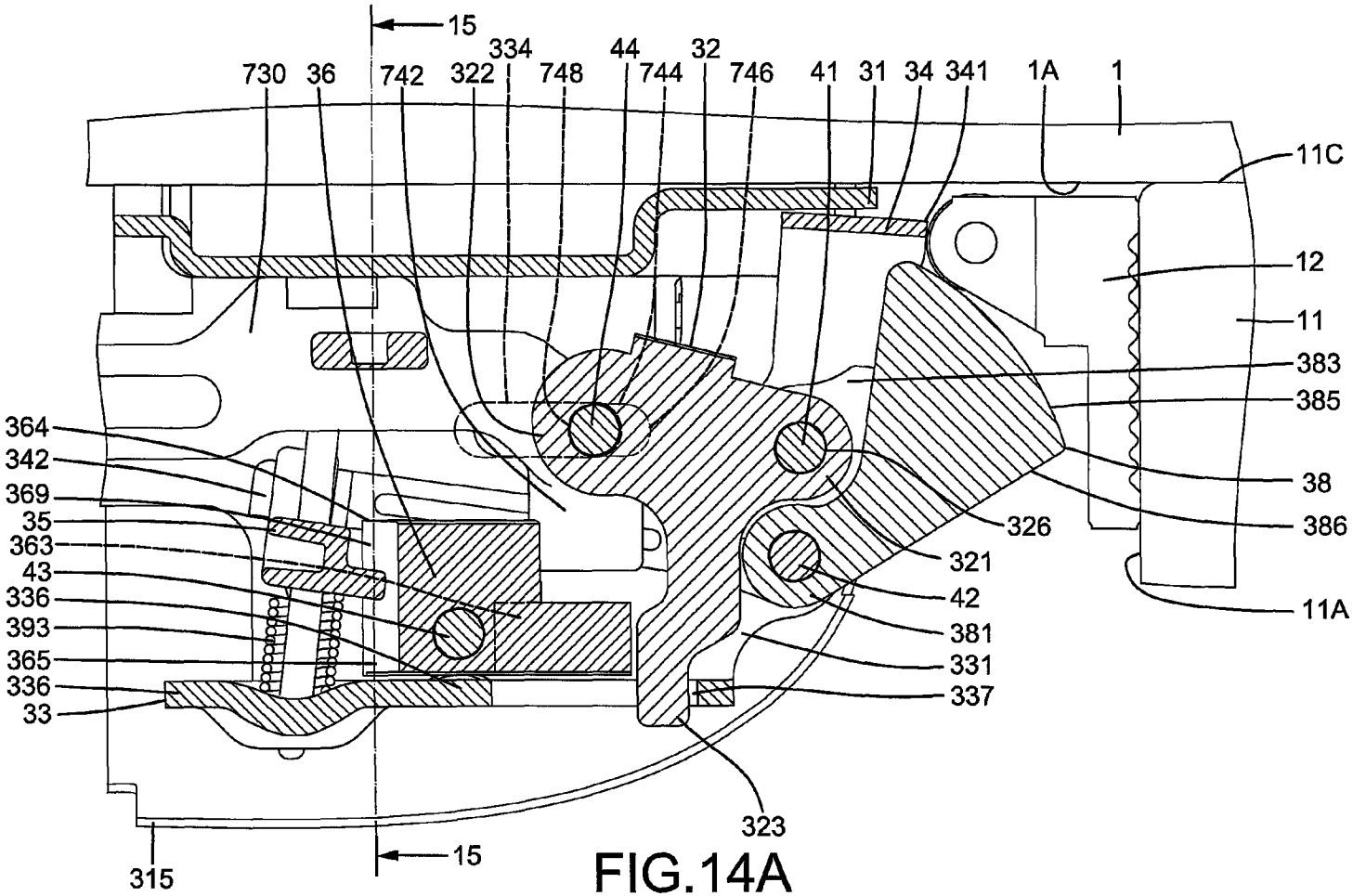
FIG. 14A shows a partial, enlarged, cross sectional view of the latch device after the door in FIG. 14 is completely closed.
Figure 18:
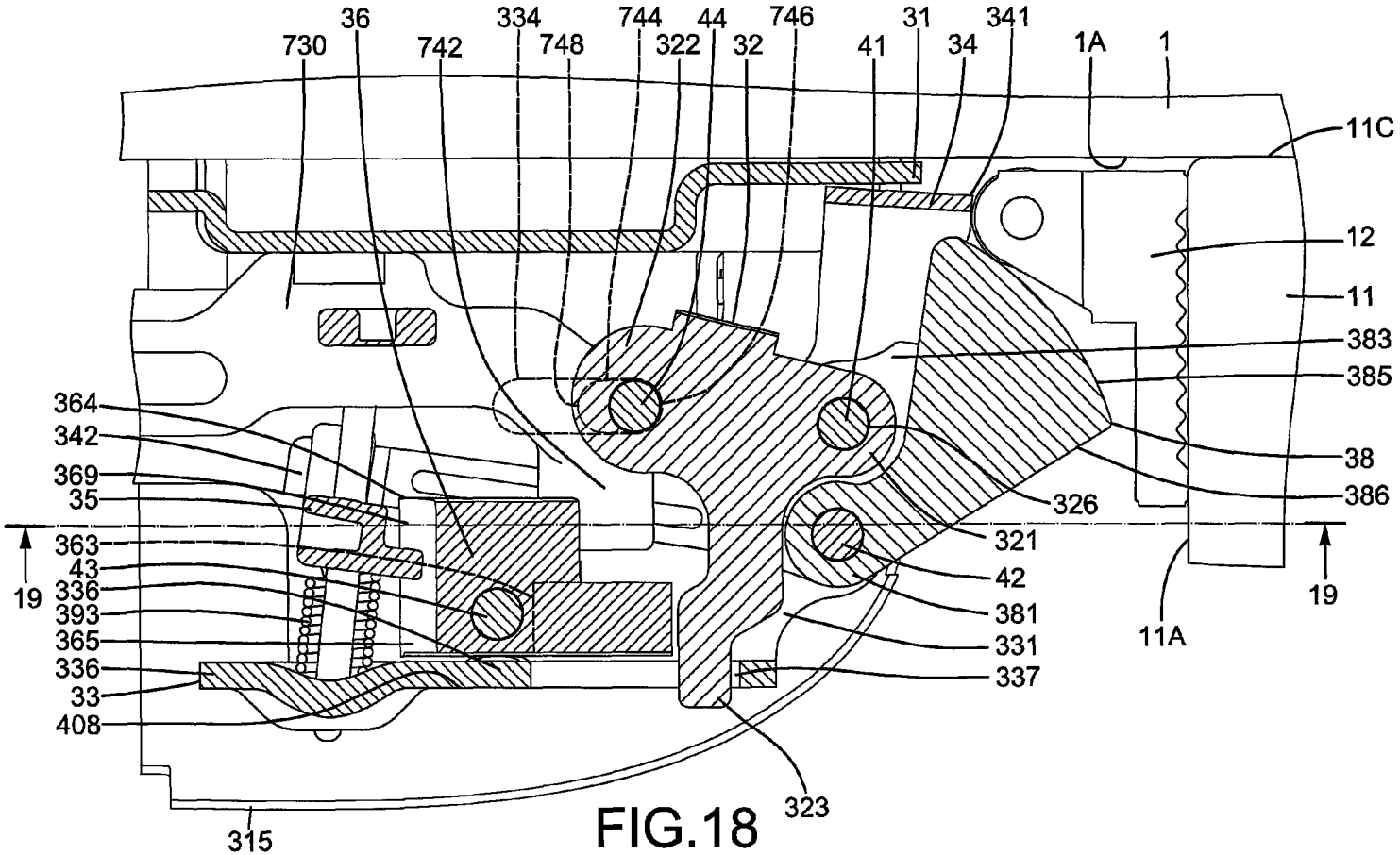
FIG. 18 shows a view similar to FIG. 14A, with the linking rod of the door lock in a second limit position of the idle travel thereof.
Figure 20:
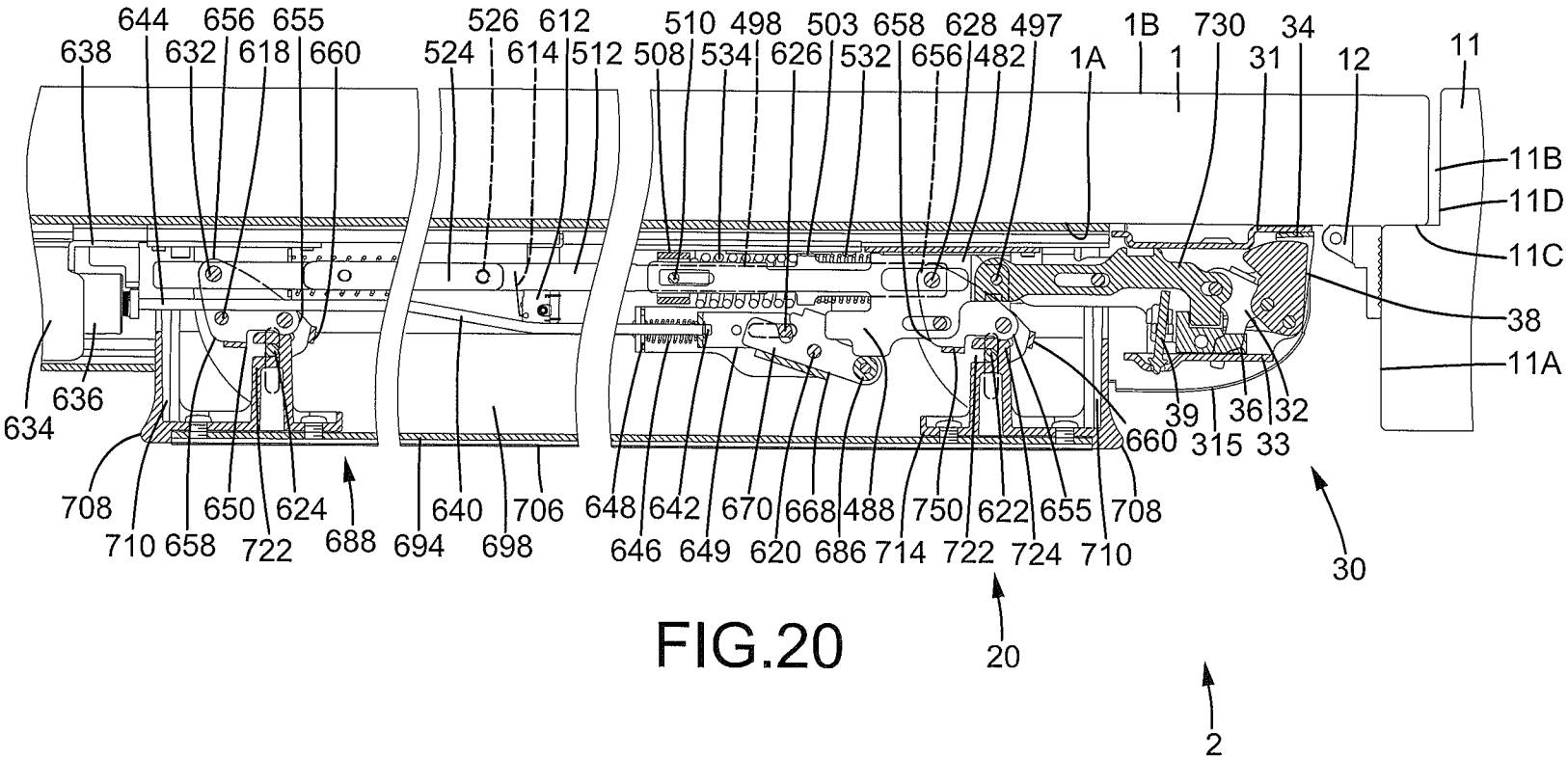
FIG. 20 shows a view similar to FIG. 1, with an operative member pressed to retract a latch.
Figure 21:
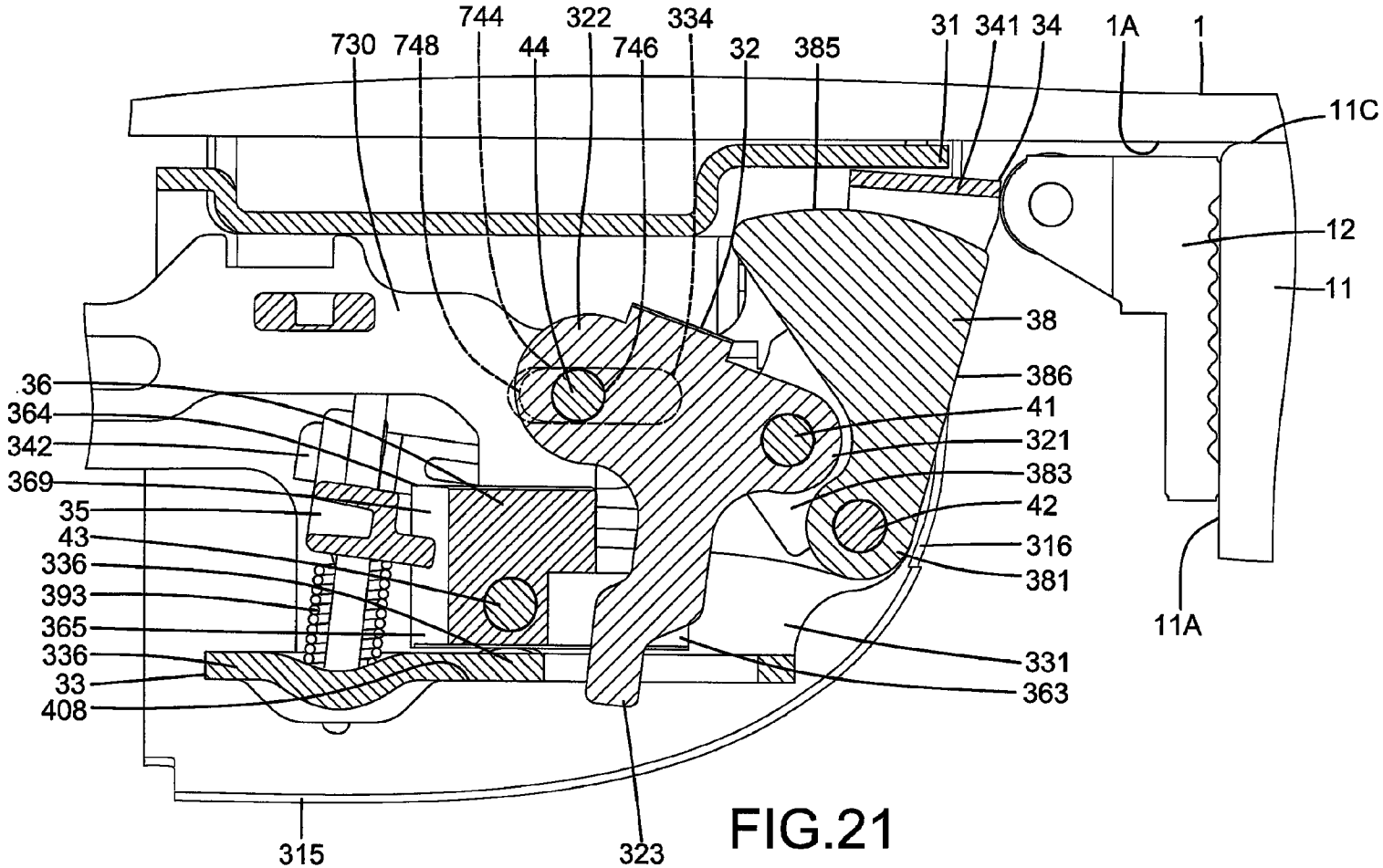
FIG. 21 shows an enlarged view of the latch device of FIG. 20.

According to the form shown, a follower 32 is pivotably connected to coupling block 383 of latch 38. Follower 32 is substantially U-shaped in cross section and includes parallel first and second side plates 324 spaced along first axis X and an interconnecting plate 325 interconnected between first and second side plates 324. Each of first and second side plates 324 includes first and second ends 321 and 322 spaced along second axis Y and an extension 323 extending from an intermediate portion thereof in a direction away from and perpendicular to interconnecting plate 325. First ends 321 of first and second side plates 324 include aligned pivot holes 326. A pivot 41 is extended through pivot hole 384 of coupling block 383 and pivot holes 326 of follower 32, allowing pivotal movement of follower 32 relative to latch 38 about a pivot axis defined by pivot 41 and parallel to and spaced from the pivot axis of latch pin 42. Extensions 323 of follower 32 are slideably extended through guide slots 337 of bracket 33. Second ends 322 of first and second side plates 324 include aligned pin holes 327 through which limiting pin 44 extends. When linking rod 730 is in the first limit position of its idle travel, limiting pin 44 is in rear end 748 of slot 744 (FIG. 14A). On the other hand, when linking rod 730 is in the second limit position of its idle travel, limiting pin 44 is in front end 746 of slot 744 (FIG. 18). Specifically, limiting pin 44 received in slot 744 is not moved when linking rod 730 is moved from the first limit position to the second limit position in an unlatching direction along second axis Y or moved from the second limit position to the first limit position in a latching direction opposite to the unlatching direction. However, when linking rod 730 in the second limit position (FIG. 18) is further moved leftward (as viewed from FIG. 18) in the unlatching direction away from latch 38 along second axis Y, limiting pin 44 is moved leftward along second axis Y and pivots latch 38 from the latching position (FIGS. 1 and 14A) to the retracted, unlatching position (FIGS. 20 and 21).

Figure 4:
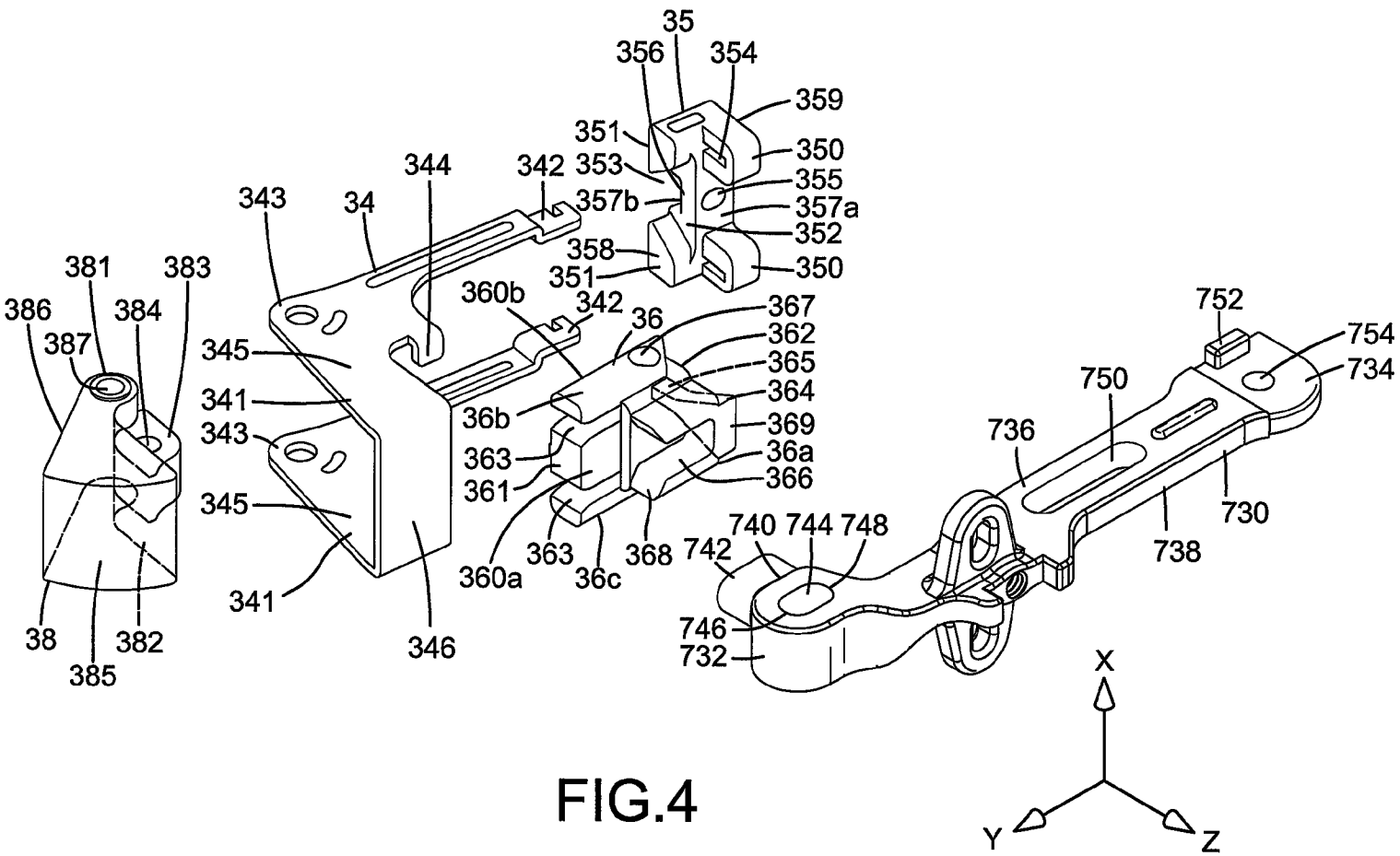
FIG. 4 shows an enlarged, exploded, perspective view of some components of the latch device of FIG. 3.
Figure 5:
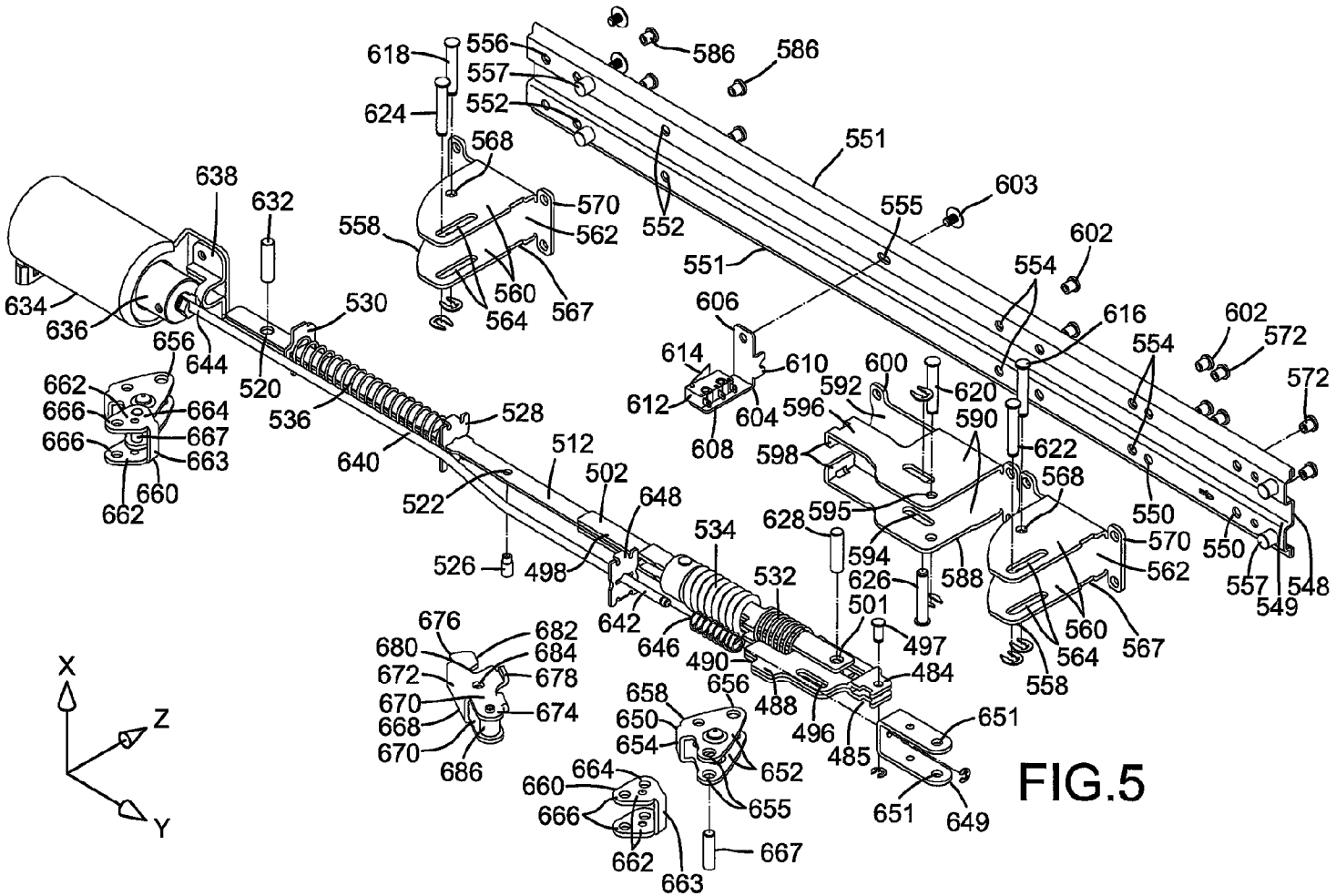
FIG. 5 shows a partial, exploded, perspective view of an operative device of FIG. 2.
Figure 6:
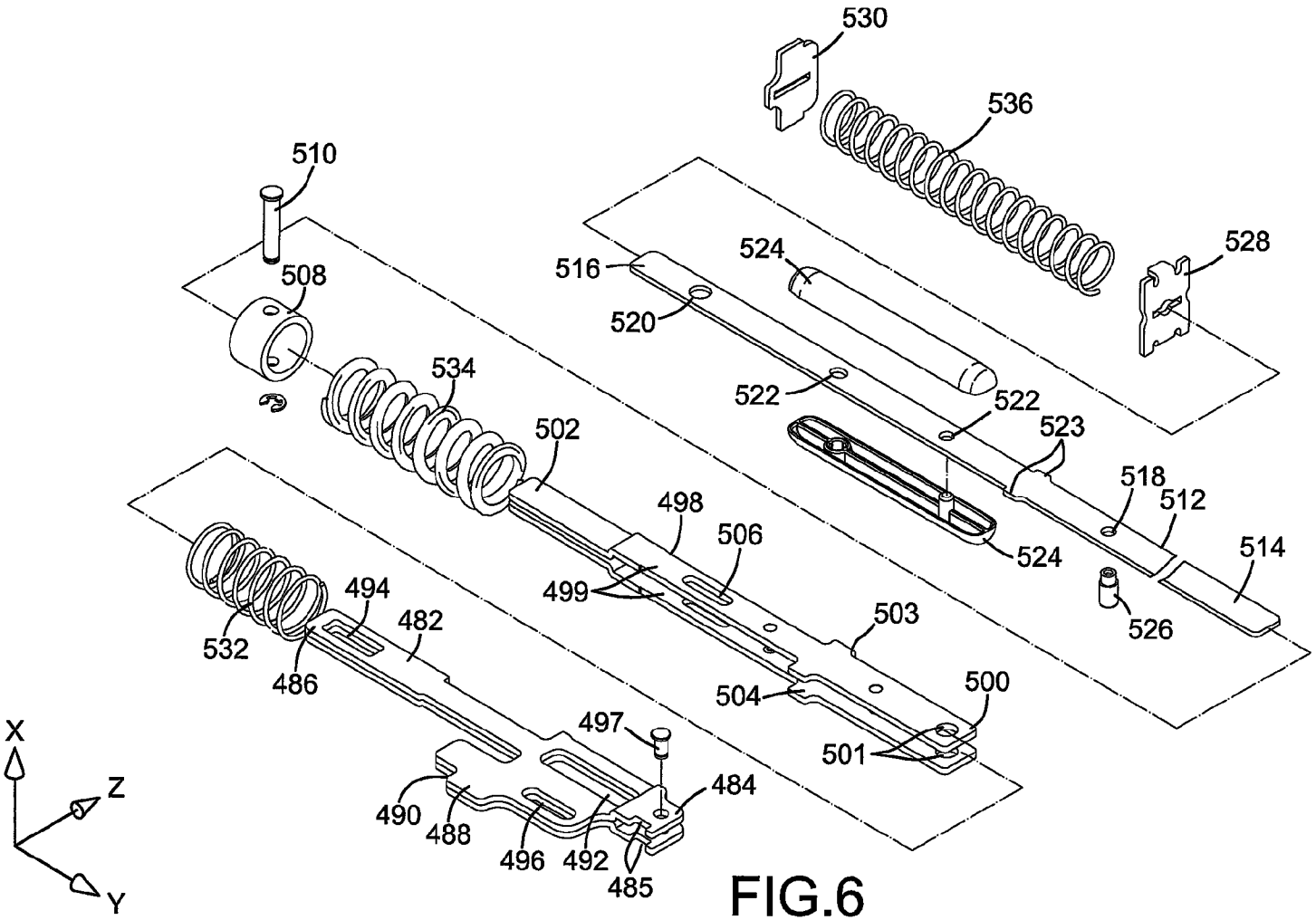
FIG. 6 shows a partial, exploded, perspective view of the operative device of FIG. 5.
Figure 7:
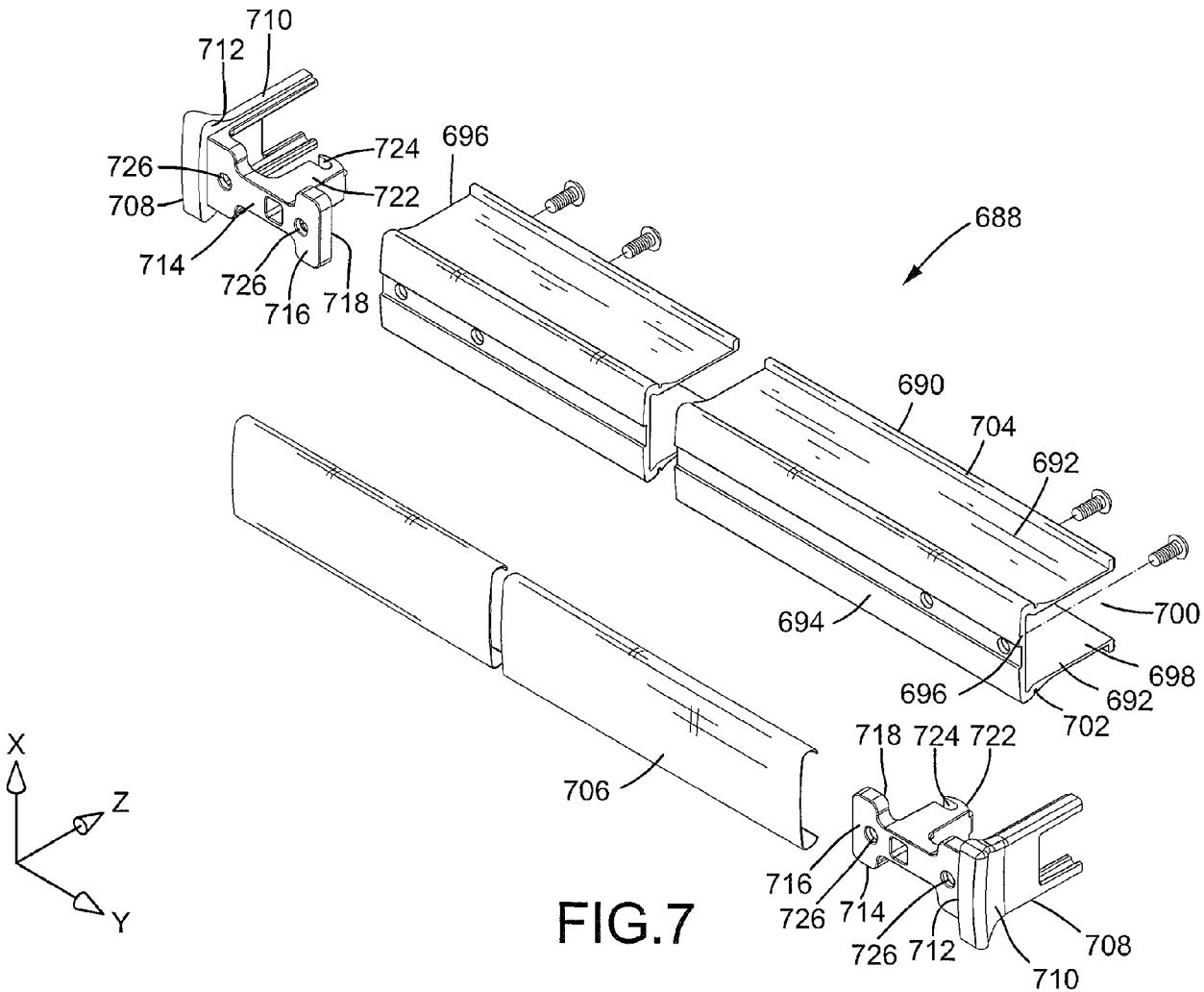
FIG. 7 shows an exploded, perspective view of an operative member of the door lock of FIG. 1.
Figure 9:
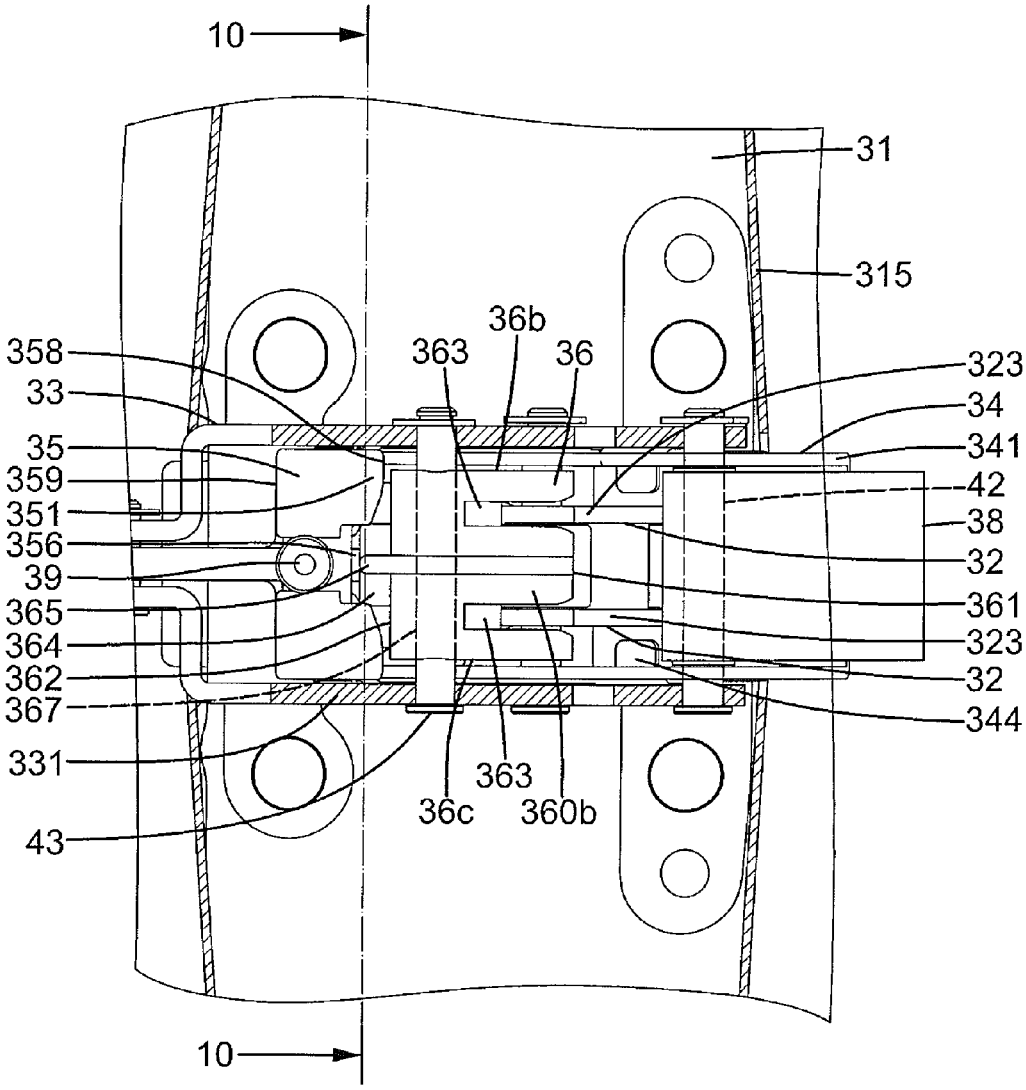
FIG. 9 shows a cross-sectional view taken along section line 9-9 of FIG. 8.

According to the form shown, a locking member 36 is mounted between first and second sidewalls 331 of bracket 33 and spaced from first end 732 of linking rod 730. Locking member 36 is substantially E-shaped in cross section. Specifically, locking member 36 includes front and rear faces 361 and 362 spaced along second axis Y. Locking member 36 further includes first and second lateral faces 360*a* and 360*b* extending perpendicularly to and between front and rear faces 361 and 362. First lateral face 360*a* faces linking rod 730 and includes a lump 36*a* formed on a rear portion thereof distant to front face 361. Lump 36*a* includes a groove 366 facing protrusion 742 of linking rod 730 and having an end opening 368. End opening 368 has a spacing to front face 361 along second axis Y smaller than groove 366. Furthermore, end opening 368 has increasing widths along first axis X away from rear face 362 of locking member 36 (FIG. 4). Locking member 36 further includes top and bottom faces 36*b* and 36*c* spaced along first axis X and extending perpendicularly to and between front and rear faces 361 and 362 and extending perpendicularly to and between first and second lateral faces 360*a* and 360*b*. A vertical hole 367 extends from top face 36*b* through bottom face 36*c* of locking member 36. A guide pin 43 is extended through pin holes 330 of bracket 33 and vertical hole 367 of locking member 36, allowing movement of locking member 36 between an upper, unlocking position (FIG. 9) and a lower, locking position (FIG. 17) spaced from the upper, unlocking position along first axis X. Two guide grooves 363 extend from front face 361 towards but spaced from rear face 362 along second axis Y. Guide grooves 363 are spaced along first axis X and spaced from top and bottom faces 36*b* and 36*c* of locking member 36. Furthermore, guide grooves 363 are spaced from groove 366 along third axis Z. A guide piece 364 in the form shown as a lug is formed on rear face 362 of locking member 36 and integrally formed with lump 36*a* as a single continuous monolithic member. Guide piece 364 includes a narrower section 365 and a wider section 369. Wider section 369 has a spacing to second lateral face 360*b* along third axis Z larger than narrower section 365 and has a width along first axis X larger than that of narrower section 365. Wider section 369 includes triangular cross sections (when viewing rear face 362 along second axis Y) and has decreasing widths toward narrower section 365 along third axis Z.

According to the form shown, a substantially U-shaped swaying plate 34 is pivotably mounted in bracket 33. Swaying plate 34 includes parallel first and second side boards 345 spaced along first axis X and received between sidewalls 331 of bracket 33. Swaying plate 34 further includes an interconnecting board 346 interconnected between first and second side boards 345. Each of first and second side boards 345 is substantially L-shaped and includes a first end 341 interconnected to interconnecting board 346, a second end 342, and a pivotal portion 343 on an intermediate portion intermediate the first and second ends 341 and 342. Second ends 342 of first and second side boards 345 are received between first and second sidewalls 331 of bracket 33. First ends 341 of first and second side boards 345 of swaying plate 34 are movable through opening 316 between a first, outer position outside of cover 315 (FIG. 8) and a second, inner position partially received in cover 315 (FIG. 14A). Latch pin 42 is extended through aligned pin holes in pivotal portions 343 of swaying plate 34 to allow pivotal movement of swaying plate 34 about the pivot axis defined by latch pin 42. Each of first and second side boards 345 includes a drive piece 344 formed on the intermediate portion thereof and adjacent to first end 341 thereof. Drive pieces 344 extend toward each other along first axis X.

Figure 10:
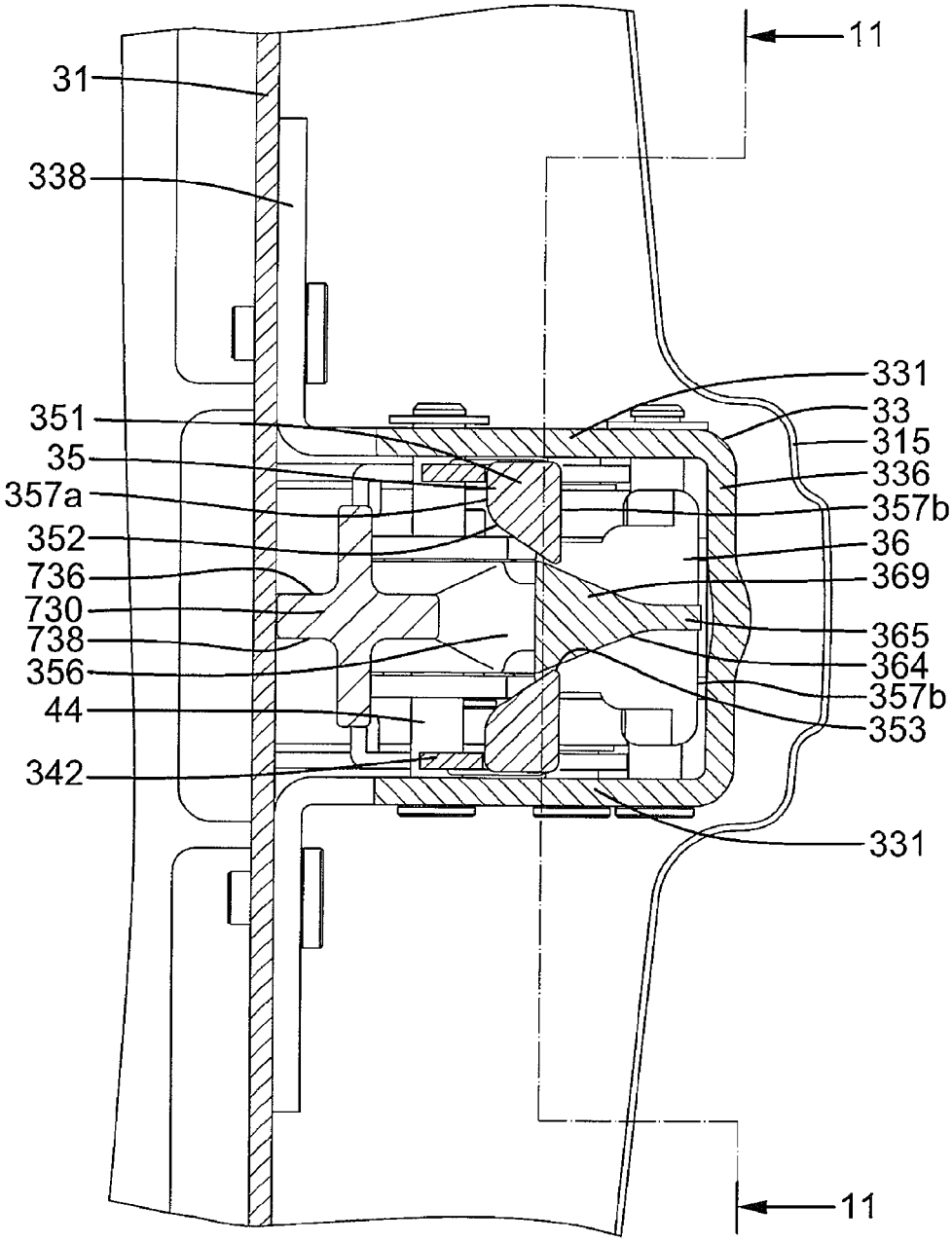
FIG. 10 shows a cross-sectional view taken along section line 10-10 of FIG. 9.
Figure 15:
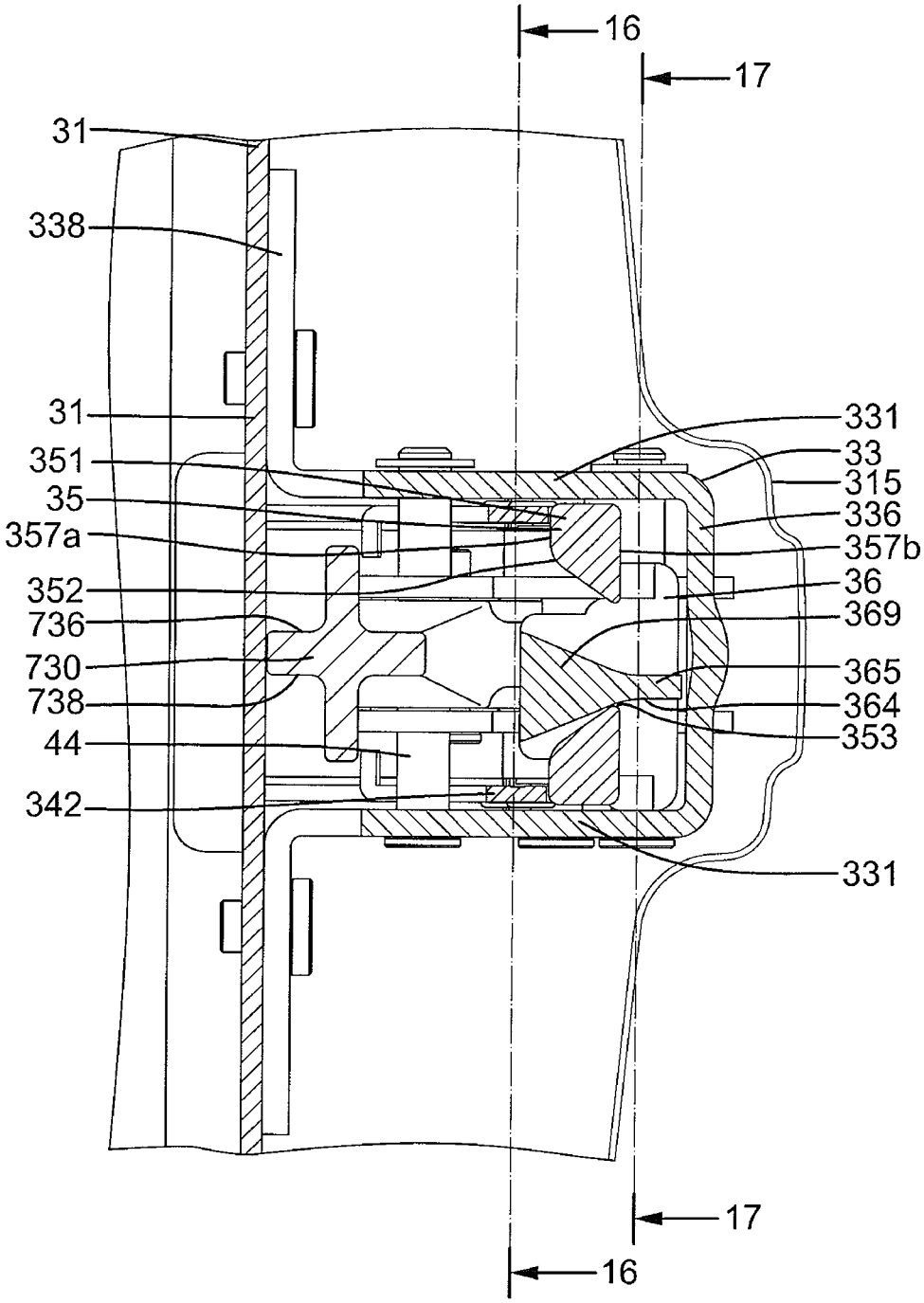
FIG. 15 shows a cross-sectional view taken along section line 15-15 of FIG. 14A.

According to the form shown, a limiting block 35 is mounted to swaying plate 34 to move therewith. Limiting block 35 is movable between a holding position (FIGS. 8 and 10) corresponding to the first, outer position (FIG. 8) of first ends 341 of first and second side boards 345 of swaying plate 34 and a releasing position (FIGS. 14A and 15) corresponding to the second, inner position (FIG. 14A) of first ends 341 of first and second side boards 345 of swaying plate 34. Limiting block 35 includes first and second lateral faces 357*a* and 357*b* spaced along third axis Z. Limiting block 35 further includes front and rear faces 358 and 359 spaced along second axis Y and extending perpendicularly to and between first and second lateral faces 357*a* and 357*b*. Upper and lower ears 350 are formed on upper and lower ends of first lateral face 357*a* and spaced along first axis X. Each of upper and lower ears 350 has an engaging groove 354 formed in a front face thereof. Second ends 342 of first and second side boards 345 of swaying plate 34 are coupled with engaging grooves 354 to allow joint pivotal movement of swaying plate 34 and limiting block 35. A through-hole 355 extends from first lateral face 357*a* through second lateral face 357*b* along third axis Z and is intermediate upper and lower ears 350. A guide groove 356 is formed in an intermediate portion of front face 358 of limiting block 35 and extends from first lateral face 357*a* through second lateral face 357*b* along third axis Z, leaving upper and lower protrusions 351 on upper and lower ends of front face 358. Guide groove 356 is substantially trapezoidal in cross section and includes a first, larger end 352 in first lateral face 357*a* and a second, smaller end 353 in second lateral face 357*b*. Second, smaller end 353 is spaced from first, larger end 352 along third axis Z. Second, smaller end 353 has a width along first axis X smaller than a width of the first, larger end 352 along first axis X. Specifically, guide groove 356 has decreasing widths from first, larger end 352 toward second, smaller end 353. Second, smaller end 353 of guide groove 356 has a minimum width along first axis X smaller than a maximum width of wider section 369 of guide piece 364 of locking member 36 along first axis X.

According to the form shown, a guide rod 39 is mounted between limiting block 35 and interconnecting wall 336 of bracket 33. Specifically, guide rod 39 includes a head 391 and a shank 392 extending from a side of head 391 and having an end slideably received in through-hole 355 of limiting block 35. The other side of head 391 is domed and includes a tip 399 extending through hole 396 of bulged section 395 to prevent head 391 from disengaging from interconnecting wall 336. An outer periphery of the domed side of the head 391 slideably abuts an inner periphery of hole 396 of bulged section 395 so that head 391 can swivel against the inner periphery of hole 396 when shank 392 moves together with limiting block 35. A spring 393 is mounted around shank 392 between the side of head 391 and second lateral face 357*b* of limiting block 35. Note that a portion of head 391 outside of hole 396 is received in cavity 397 to avoid interference in operation of guide rod 39 and other components.

According to the form shown, operative device 20 is coupled with second end 734 of linking rod 730. Operative device 20 includes a substantially U-shaped casing 538 fixed to first side 1A of door 1. Casing 538 includes two lateral walls and a connecting wall between the lateral walls, defining a compartment 540 having an opening 542. Opening 542 has a width along first axis X slightly smaller than the width of compartment 540 along first axis X. Two ribs 544 are formed on an inner face of each lateral wall and located in compartment 540. An end of casing 538 is adjacent to a side of cover 315 distal to opening 316. A cover plate 546 is mounted in opening 542 and has a length along second axis Y smaller than that of opening 542 along second axis Y, such that an end of opening 542 adjacent to cover 315 is not covered by cover plate 546.

According to the form shown, operative device 20 further includes a mounting plate 548 having cross sections with alternately disposed protruded portions and recessed portions. Mounting plate 548 includes two engagement ends 551 spaced along first axis X. A recess 549 is defined between engagement ends 551. Mounting plate 548 further includes four first positioning holes 550, four second positioning holes 552, four third positioning holes 554, two fourth positioning holes 556, and a fixing hole 555. Each third positioning hole 554 is located between first positioning holes 550 and fixing hole 555. Second positioning holes 552 are located between fixing hole 555 and fourth positioning holes 556. Four pads 557 are fixed to a side of mounting plate 548, with two pads 557 located between an end of mounting plate 548 and first positioning holes 550, and the other two pads 557 located between second positioning holes 552. The end of mounting plate 548 is adjacent to the side of cover 315 distal to opening 316. Each of engagement ends 551 of mounting plate 548 is engaged with a corresponding rib 544.

According to the form shown, operational device 20 further includes substantially U-shaped first and second brackets 558 spaced along second axis Y. Second bracket 558 has a spacing to bracket 33 along second axis Y larger than first bracket 558. Each of first and second brackets 558 includes first and second plates 560 spaced along first axis X and a connecting plate 562 extending between first and second plates 560. Each of first and second plates 560 includes a sliding slot 564 and an axle hole 568. A pair of lugs 570 is formed on each of two ends of connecting plate 562 of each of first and second brackets 558. Each axle hole 568 is located between connecting plate 562 and a corresponding sliding slot 564. An insertion groove 567 is formed on an edge of each of first and second plates 560. Each lug 570 of first bracket 558 is aligned with one of first positioning holes 550 and is fixed by a first positioning member 572 (such as a screw). Each lug 570 of second bracket 558 is aligned with one of second positioning holes 552 and is fixed by a second positioning member 586 (such as a screw). First and second brackets 558 are received in compartment 540 of casing 538. Sliding slots 564 of first and second brackets 558 are adjacent to opening 542 of casing 538. A first axle 616 is pivotably received in axle holes 568 of first bracket 558. A first pin 622 is slideably received in sliding slots 564 of first bracket 558, such that first pin 622 can slide in sliding slots 564 of first bracket 558 along third axis Z. A second axle 618 is pivotably received in axle holes 568 of second bracket 558. A second pin 624 is slideably received in sliding slots 564 of second bracket 558, such that second pin 624 can slide in sliding slots 564 of second bracket 558 along third axis Z.

According to the form shown, operational device 20 further includes a third bracket 588. Third bracket 588 includes first and second walls 590 spaced along first axis X and a connecting wall 592 extending between first and second walls 590. Each of first and second walls 590 includes a movement slot 594 and an axle hole 595. Each movement slot 594 is located between a corresponding axle hole 595 and connecting wall 592 along third axis Z. An arm 596 extends from an edge of each of first and second walls 590 and has an engagement tab 598. Engagement tabs 598 of arms 596 are aligned with and spaced from each other along first axis X. A pair of lugs 600 is formed on each of two ends of connecting wall 592 of third bracket 588. Each lug 600 of third bracket 588 is aligned with one of third positioning holes 554 of mounting plate 548 and is fixed by a third positioning member 602 (such as a screw). A third axle 620 is pivotably received in axle holes 595 of third bracket 588. A third pin 626 is slideably received in movement slots 594 of third bracket 588, such that third pin 626 can slide in movement slots 594 of third bracket 588 along third axis Z.

According to the form shown, operative device 20 further includes a substantially L-shaped fixing plate 604 mounted to mounting plate 548 and a switch 612 mounted to the fixing plate 604. Fixing plate 604 includes a first section 606 extending perpendicularly to third axis Z and a second section 608 extending perpendicularly to first axis X. A protrusion 610 extends from a side of first section 606 along third axis Z. Switch 612 is fixed to second section 608 and includes an actuating plate 614. A screw 603 is extended through fixing hole 555 of mounting plate 548 into first section 606 of fixing plate 604. Protrusion 610 is received in recess 549 of mounting plate 548. Thus, fixing plate 604 is securely fixed to mounting plate 548. Switch 612 is received in compartment 540 of casing 538 with actuating plate 614 facing second bracket 558. Switch 612 is electrically connected to a burglar-proof system 756 (FIG. 1).

Figure 22:
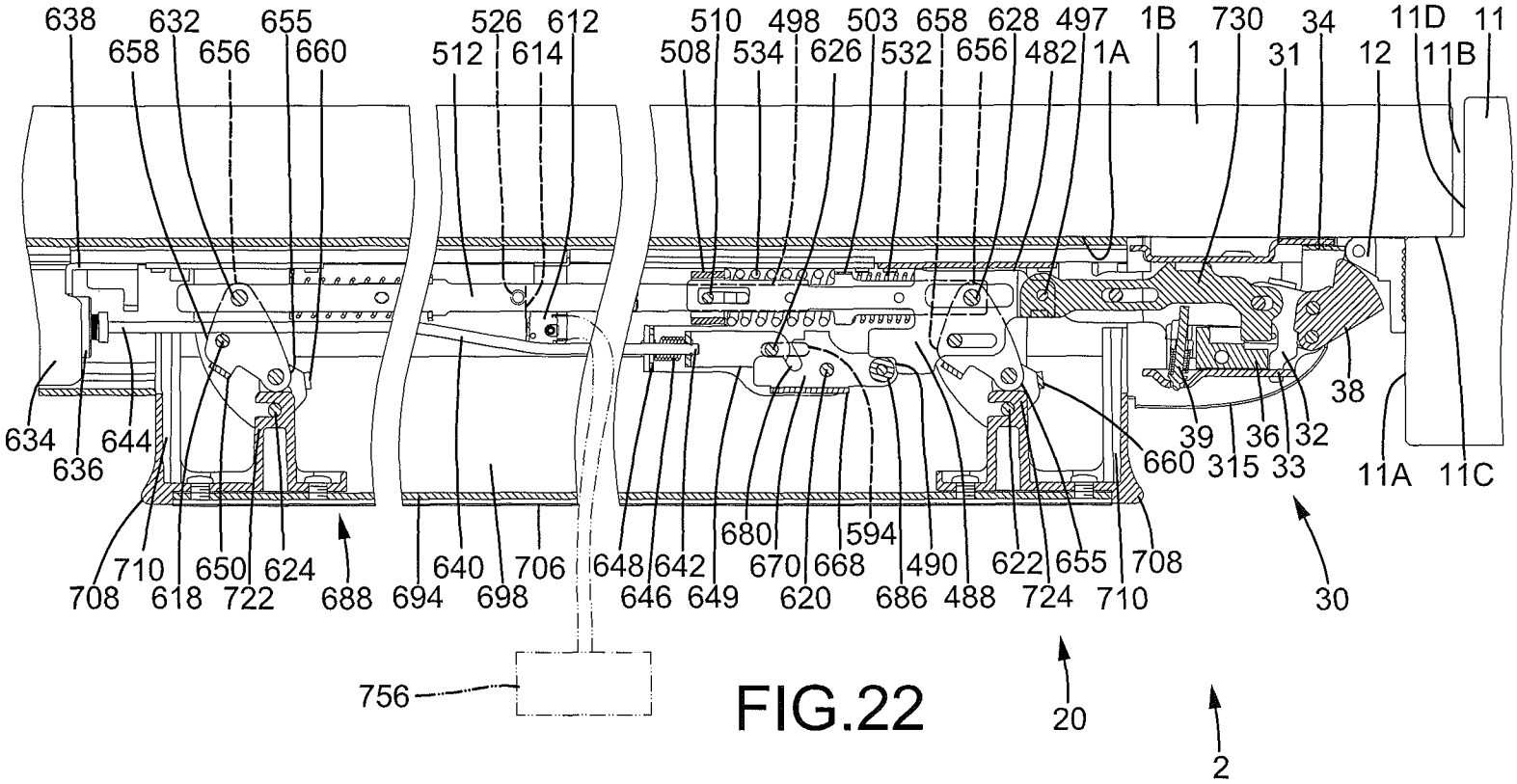
FIG. 22 shows a view similar to FIG. 1, with a draw bar moved backward by a driving device.

According to the form shown, operative device 20 further includes a driving device 634 comprised of an electromagnetic driver or the like. Driving device 634 includes a driving member 636 movable between an extended position and a retracted position. A draw bar 640 includes a tail 644 fixed to driving member 636 and a head 642 spaced from tail 644 along second axis Y. When driving device 634 is not electrified, driving member 636 and draw bar 640 are in the extended position (FIG. 1). When driving device 634 is electrified, driving member 636 and draw bar 640 are moved to the retracted position (FIG. 22). Draw bar 640 in the extended position has a spacing to latch 38 smaller than that in the retracted position. A substantially L-shaped attachment plate 638 extends outward from an outer periphery of driving device 634. Two screws are extended through two fourth positioning holes 556 into attachment plate 638 to fix attachment plate 638, such that driving device 634 is located in compartment 540 of casing 538.

According to the form shown, operative device 20 further includes a follower plate 482 slideably mounted in first bracket 558 and third bracket 588. Follower plate 482 includes two metal sheets fixed to each other by bonding or welding. Follower plate 482 includes front and rear ends 484 and 486 spaced along second axis Y. An extension 488 extends from an edge of follower plate 482 and is located between front and rear ends 484 and 486. A stop 490 is formed on extension 488. Follower plate 482 includes first and second grooves 492 and 494. First groove 492 is located between second groove 494 and front end 484. Second groove 494 is located between first groove 492 and rear end 486. Extension 488 includes an elongated slot 496 parallel to first groove 492 and spaced from first groove 492 along third axis Z. Follower plate 482 further includes two insertion grooves 485 formed in a side of front end 484 and spaced along first axis X. Each insertion groove 485 is spaced from elongated slot 496 of extension 488 along second axis Y. A spacing between an end face of front end 484 and each insertion groove 485 along second axis Y is smaller than a spacing between the end face of front end 484 and elongated slot 496.

Follower plate 482 is received between first and second plates 560 of first bracket 558 and between first and second walls 590 of third bracket 588. A first spring 532 is mounted around a portion of follower plate 482 adjacent to extension 488 and between front and rear ends 484 and 486. A first peg 628 is slideably received in first groove 492 of follower plate 482. Front end 484 of follower plate 482 faces latch device 30.

Second end 734 of linking rod 730 is connected to front end 484 of follower plate 482. Insertion blocks 752 of linking rod 730 are engaged in insertion grooves 485 of extension 488. A connecting pin 497 is extended through front end 484 of follower plate 48 and hole 745 in second end 734 of linking rod 730. Thus, linking rod 730 and follower plate 482 can move jointly.

According to the form shown, operative device 20 further includes a connecting member 498 slideably received in casing 538. Connecting member 498 includes first and second plates 499 made of metal and spaced along first axis X. Connecting member 498 further includes a connecting plate 503 extending between intermediate portions of first and second plates 499. A length of connecting plate 503 along second axis Y is smaller than that of each of first and second plates 499 along second axis Y. Each of first and second plates 499 includes first and second ends 500 and 502 spaced along second axis Y. Each of first and second plates 499 further includes a push slot 506 between first and second ends 500 and 502. A hole 501 is defined in first end 500 of each of first and second plates 499. A protrusion 504 is formed on the intermediate portion of each of first and second plates 499 and between first and second ends 500 and 502. Protrusions 504 are aligned with connecting plate 503 and spaced from connecting plate 503 along third axis Z.

Rear end 486 of follower plate 482 is mounted between first and second plates 499 of connecting member 498. Holes 501 of first and second plates 499 are aligned with first groove 492 of follower plate 482. Second groove 494 of follower plate 482 is aligned with push slot 506 of connecting member 498. First peg 628 received in first groove 492 is extended through holes 501 of first and second plates 499 of connecting member 498, such that connecting member 498 can slide relative to follower plate 482 along second axis Y in a length extent of first groove 492 along second axis Y. First spring 532 is located between a side of protrusions 504/connecting plate 503 and first groove 492 of follower plate 482. A second spring 534 is mounted around first and second plates 499 of connecting member 498 and has an end abutting the other side of protrusions 504/connecting plate 503. A sleeve 508 is mounted around first and second plates 499 of connecting member 498 and has an end pressing against the other end of second spring 534. A pin 510 is extended through sleeve 508 in a diametrical direction and through push slot 506 of connecting member 498 and through second groove 494 of follower plate 482, such that sleeve 508 keeps pressing against the other end of second spring 534. Furthermore, second spring 534 biases sleeve 508 such that pin 510 abuts against an end of push slot 506 adjacent to second ends 502 of first and second plates 499. Since second spring 534 biases sleeve 508 and pin 510, when connecting member 498 moves along second axis Y, pin 510 presses against an end wall of second groove 494 of follower plate 482, causing joint movement of follower plate 482 and connecting member 498 along second axis Y.

According to the form shown, operative device 20 further includes a connecting rod 512 having a connecting end 514 and a pull end 516 spaced from connecting end 514 along second axis Y. Connecting rod 512 further includes a mounting hole 518, two coupling holes 522, and an engaging hole 520. Coupling holes 522 are located between engaging hole 520 and mounting hole 518. Mounting hole 518 is located between engaging holes 522 and connecting end 514. Engaging hole 520 is located between coupling holes 522 and pull end 516. Connecting rod 512 further includes two protrusions 523 on two lateral edges of an intermediate portion between connecting end 514 and pull end 516 of connecting rod 512. Protrusions 523 are located between mounting hole 518 and coupling holes 522.

Figure 12:
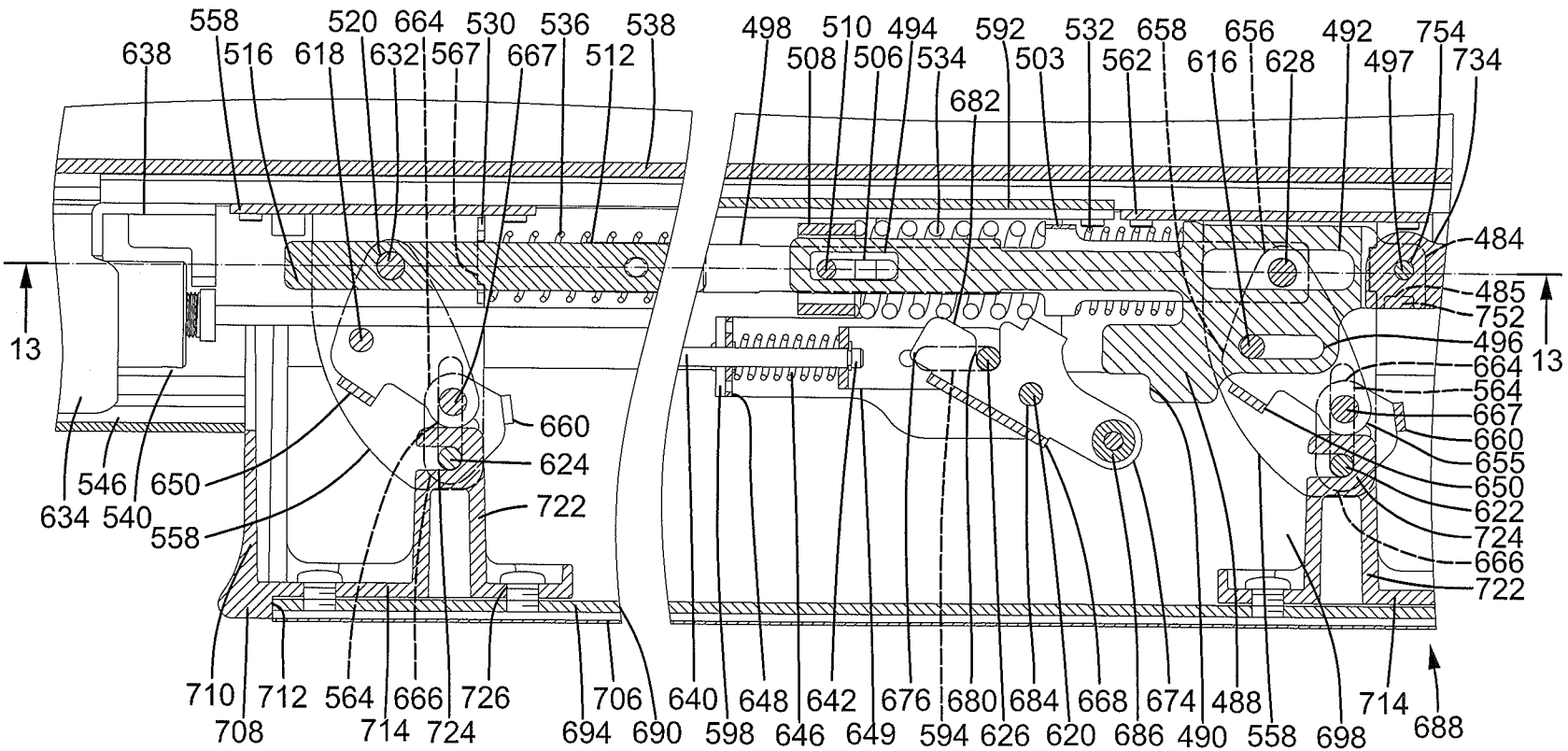
FIG. 12 shows an enlarged view of the operative device of FIG. 1.
Figure 13:
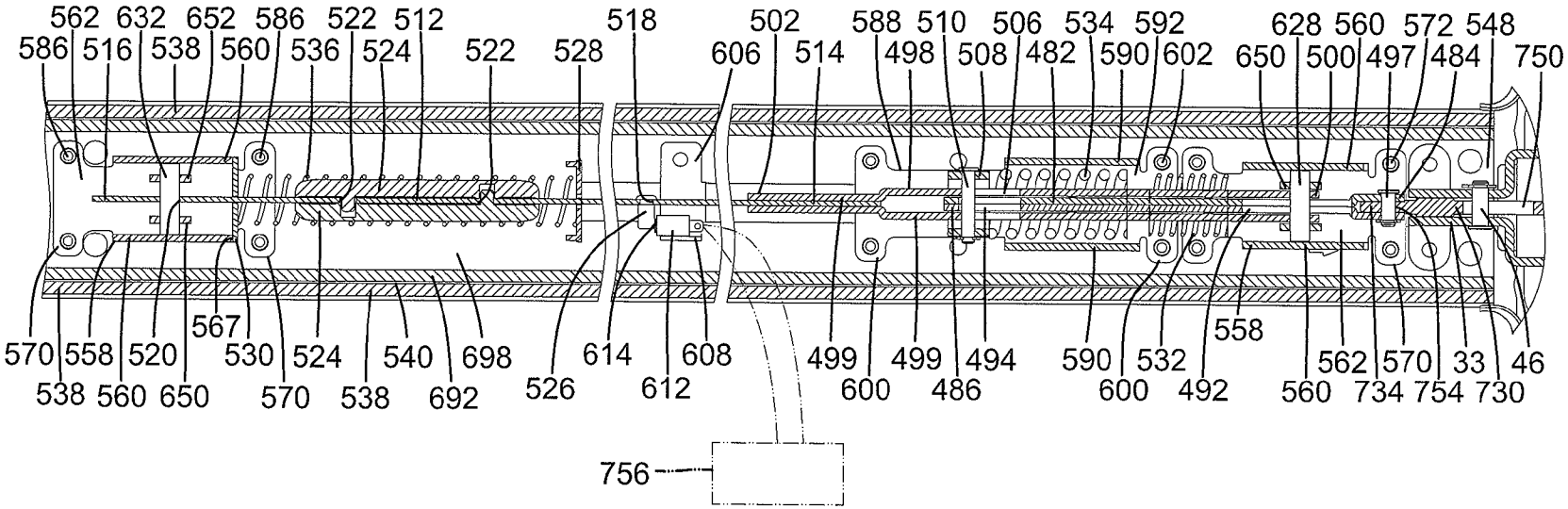
FIG. 13 shows a cross-sectional view taken along section line 13-13 of FIG. 12.

In the form shown, connecting end 514 of connecting rod 512 is located between and welded to second ends 502 of first and second plates 499 of connecting member 498, allowing joint movement of connecting rod 512 and connecting member 498 along second axis Y. Connecting rod 512 is received between first and second plates 560 of second bracket 558 and first and second walls 590 of third bracket 588. First and second supports 524 are engaged on two opposite surfaces of connecting rod 512 and cover coupling holes 522. A pressing block 526 is fixed to mounting hole 518 of connecting rod 512 such as by riveting. First and second stop boards 528 and 530 are mounted on connecting rod 512. First stop board 528 abuts protrusions 523. Second stop board 530 is engaged in insertion grooves 567 of second bracket 558 (FIGS. 12 and 13). A third spring 536 is mounted between first and second stop boards 528 and 530 and around first and second supports 524. Third spring 536 biases connecting rod 512 and connecting member 498 to move in the latching direction along second axis Y. First and second supports 524 avoid distortion of third spring 536 when compressed.

According to the form shown, operative device 20 further includes substantially U-shaped first and second traction members 650 pivotably mounted to first and second brackets 558, respectively. Each of first and second traction members 650 includes first and second portions 652 spaced along first axis X and having substantially triangular cross sections. Each of first and second traction members 650 further includes a connecting portion 654 extending between first and second portions 652. Each of first and second portions 652 of each of first and second traction members 650 includes spaced first, second, and third corners 655, 656, and 658. First traction member 650 is received between first and second plates 560 of first bracket 558. Second traction member 650 is received between first and second plates 560 of second bracket 558. First axle 616 is extended through third corner 658 of first traction member 650 and elongated slot 496 of follower plate 482. Thus, first traction member 650 can pivot relative to first bracket 558 about a pivot axis defined by first axle 616 and parallel to the pivot axis defined by latch pin 42. Second axle 618 is extended through third corner 658 of second traction member 650. Thus, second traction member 650 can pivot relative to second bracket 558 about a pivot axis defined by second axle 618 and parallel to the pivot axis defined by first axle 616. First peg 628 is extended through second corner 656 of first traction member 650, pivotably connecting first traction member 650 to first ends 500 of first plates 499 of connecting member 498. A second peg 632 is extended through second corner 656 of second traction member 650 and engaging hole 520 of connecting rod 512, pivotably connecting second traction member 650 to connecting rod 512. When first and second traction members 650 pivot, connecting rod 512 and connecting member 498 are pushed to move in the unlatching direction along second axis Y.

According to the form shown, operative device 20 further includes U-shaped first and second follower element 660 pivotably connected to first and second traction members 650, respectively. Each of first and second follower elements 660 includes first and second plates 662 spaced along first axis X and a connecting plate 663 extending between first and second plates 662. Each of first and second plates 662 includes first and second pivotal portions 664 and 666. First and second portions 652 of first traction member 650 are received between first and second plates 662 of first follower element 660. First and second portions 652 of second traction member 650 are received between first and second plates 662 of second follower element 660. Each of two fourth axles 667 is extended through first pivotal portion 664 of one of first and second follower elements 660 and first corner 655 of one of first and second traction members 650. Thus, first follower element 660 is pivotable relative to first traction member 650 about a pivot axis defined by one of fourth axles 667 and parallel to the pivot axis defined by latch pin 42, and second follower element 660 is pivotable relative to second traction member 650 about a pivot axis defined by the other fourth axle 667 and parallel to the pivot axis defined by latch pin 42. First pin 622 received in sliding slots 564 of first bracket 558 is extended through second pivotal portion 666 of first follower element 660. Second pin 624 received in sliding slots 564 of second bracket 558 is extended through second pivotal portion 666 of second follower element 660. Thus, first follower element 660 can cause pivotal movement of first traction member 650 while sliding in sliding slot 564 of first bracket 558 along third axis Z. Likewise, second follower element 660 can cause pivotal movement of second traction member 650 while sliding in sliding slot 564 of second bracket 558 along third axis Z.

According to the form shown, operative device 20 further includes a U-shaped stop member 668 pivotably mounted to third bracket 588. Stop member 668 includes first and second walls 670 spaced along first axis X and a connecting wall 672 extending between first and second walls 670. Each of first and second walls 670 includes first and second ends 674 and 676. A notch 680 is defined in each of first and second walls 670 and located adjacent to second end 676, and a face 682 is defined between second end 676 and notch 680. A pivot hole 684 is defined in each of first and second walls 670 and located between notch 680 and first end 674. A bend 678 extends from an edge of each of first and second walls 670 along first axis X. A stop block 686 is formed between first ends 674 of first and second walls 670.

Stop member 668 is received between first and second walls 590 of third bracket 588. Pivot holes 684 of stop member 668 are aligned with axle holes 595 of third bracket 588. Third axle 620 is extended through pivot holes 684 of stop member 668, such that stop member 668 can pivot about a pivot axis defined by third axle 620 and parallel to the pivot axis defined by latch pin 42. Stop block 686 of stop member 668 faces stop 490 of follower plate 482. Bends 678 abut the inner faces of first and second walls 590 of third bracket 588 to provide stable pivotal movement of stop member 668.

According to the form shown, operative device 20 further includes a substantially U-shaped connecting element 649 fixed to head 642 of draw bar 640. Connecting element 649 includes two arms having aligned pin holes 651 and an intermediate portion between the arms. Third pin 626 is extended through pin holes 651 of connecting member 649. A third stop 648 is mounted between connecting member 649 and engagement tabs 598 of third bracket 588. A fourth spring 646 is mounted around head 642 of draw bar 640 and between third stop 648 and the intermediate portion of connecting member 649. When draw bar 640 is moved to the extended position, connecting member 649 moves third pin 626 into notches 680 of stop member 668. When draw bar 640 is moved to the retracted position, connecting member 649 is moved in the unlatching direction along axis Y by draw bar 640 and compresses fourth spring 646. Furthermore, connecting member 649 causes third pin 626 in notches 680 to push stop member 668 to pivot, such that stop block 686 abuts stop 490 of follower plate 482. Third pin 626 moves to faces 682 of stop member 668. Stop member 668 prevents follower plate 482 from moving in the unlatching direction along second axis Y.

According to the form shown, operative device 20 further includes an operative member 688 movably mounted on casing 538. Operative member 688 includes a body 690 having U-shaped cross sections. Body 690 includes first and second walls 692 spaced along first axis X and a connecting wall 694 extending between first and second walls 692. Body 690 includes two end faces 696 spaced along second axis Y and respectively formed by end faces of first and second walls 692 and connecting walls 694. First and second walls 692 and connecting wall 694 together define a space 698 having an opening 700 spaced from connecting wall 694 by third axis Z. Space 698 extends from one of end faces 696 through the other end face 696. A ridge 704 is formed on an outer face of a distal edge of each of first and second walls 692. An insertion groove 702 is defined in the outer face of each of first and second walls 692 and located adjacent to connecting wall 694 and spaced from ridge 704 along third axis Z.

Body 690 is mounted in compartment 540 of casing 538 by moving body 690 along third axis Z. Opening 700 of body 690 faces ribs 544 of casing 538. First and second walls 692 of body 690 are received in opening 542 of casing 538. The spacing between ridges 704 of body 690 along first axis X is slightly larger than a height of opening 542 of casing 538 along first axis X, preventing body 690 from disengaging from casing 538 along third axis Z. Furthermore, a sum of a length of cover plate 546 along second axis Y and a length of operative member 688 along second axis Y is approximately the same as a length of casing 538 along second axis Y. Thus, cover plate 546 and body 690 seal compartment 540 of casing 538.

According to the form shown, operative device 20 further includes a decorative plate 706 and first and second end caps 708. Decorative plate 706 has substantially C-shaped cross sections. Each of first and second end caps 708 includes a first portion 710 having a sidewall 712. Each of first and second end caps 708 further includes a second portion 714 extending from sidewall 712 of first portion 710 and having substantially I-shaped cross sections. Each second portion 714 includes top and bottom faces 716 and 718 spaced along third axis Z. A hook 722 extends outward from bottom face 718 of each second portion 714 along third axis Z and includes an insertion groove 724 extending from a face of hook 722 towards but spaced from the other face of hook 722 along second axis Y. Insertion groove 724 of each hook 722 is spaced from bottom face 718 of a corresponding second portion 714 along third axis Z and extends in a direction parallel to the unlatching direction. Insertion groove 724 of each of first and second end caps 708 faces driving device 634 (leftwards in FIG. 1). Two through-holes 726 are defined in second portion 714 of each of first and second end caps 708 with hook 722 located between through-holes 726 along second axis Y.

Decorative plate 706 is fixed to connecting wall 694 of body 690 and includes two lateral edges engaged in insertion grooves 702 of body 690. Decorative plate 706 provides an aesthetic appearance for body 690. First and second end caps 708 are mounted in two ends of space 698. Sidewalls 712 of first portions 710 of first and second end caps 708 abut end faces 696 of body 690. Second portions 714 of first and second end caps 708 extend into space 698 of body 690. Top faces 716 of second portions 714 face connecting wall 694 of body 690. Hooks 722 of second portions 714 face opening 700 of body 690. Screws are mounted in space 698 and extend through through-holes 726 of first and second end caps 708 into connecting wall 694 of body 690. First and second pins 622 and 624 are inserted into insertion grooves 724 of hooks 722 of first and second end caps 708. When body 690 is moved along third axis Z, first and second end caps 708 urge first and second pins 622 and 624 to move along third axis Z, driving first and second follower elements 660 to cause movement of connecting member 498 and connecting rod 512 in the unlatching direction along second axis Y.

Figure 8:
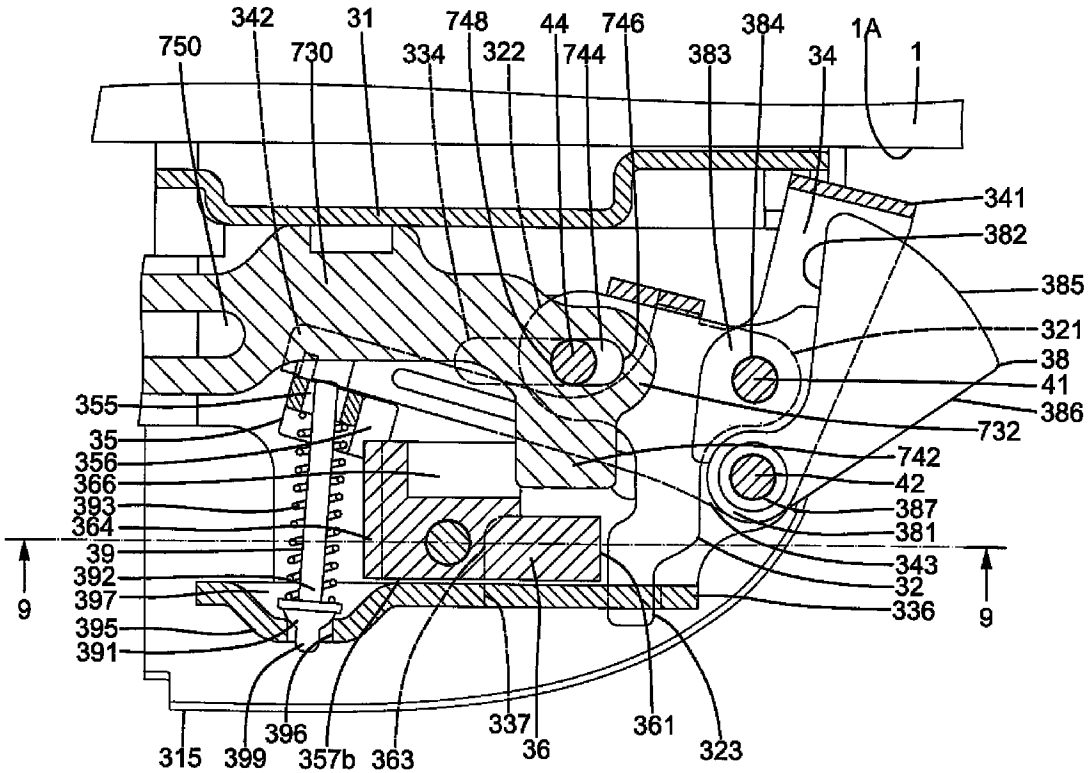
FIG. 8 shows a partial, enlarged, cross-sectional view of the door and the door lock of FIG. 1, with the door in an open position and with a linking rod of the door lock in a first limit position of an idle travel thereof.
Figure 11:
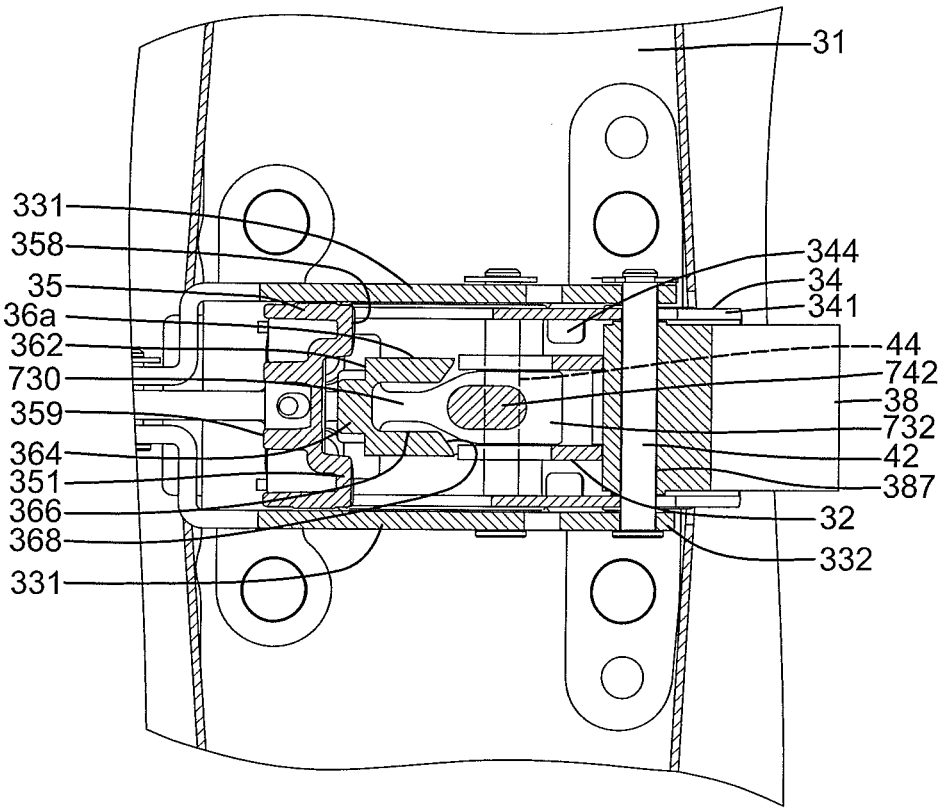
FIG. 11 shows a cross-sectional view taken along section line 11-11 of FIG. 10.

Now that the basic construction of door lock 2 of the present invention has been explained, the operation and some of the advantages of door lock 2 can be set forth and appreciated. In particular, for the sake of explanation, it will be assumed that door 1 is not closed (FIG. 8) and that latch 38 is in its extended, latching position. First ends 341 of first and second side boards 345 of swaying plate 34 are in the first, outer position outside of cover 315 under the action of spring 393 that presses against limiting block 35 fixed to swaying plate 34. In this case, limiting block 35 is in the holding position holding locking member 36 in its upper, unlocking position (FIG. 9), and wider section 369 of guide piece 364 of locking member 36 is received in second, smaller end 353 of guide groove 356 of limiting block 35. Furthermore, guide grooves 363 of locking member 36 are aligned with extensions 323 of follower 32. Further, linking rod 730 is in its first limit position (FIG. 8). Specifically, protrusion 742 of linking rod 730 is aligned with but outside of groove 366 (FIG. 11), and limiting pin 44 is in front end 746 of slot 744. In this state, latch 38 can be pivoted from the latching position to the unlatching position.

When closing door 1, third face 386 of latch 38 is pressed against by stop 12 and, thus, pivots inward. Follower 32 pivots inward together with latch 38 so that extensions 323 of follower 32 are extended through and engaged with guide grooves 363 of locking member 36. Pivotal movement of follower 32 also causes movement of limiting pin 44 in the unlatching direction away from latch 38, which, in turn, moves linking rod 730 in the unlatching direction away from latch 38 so that protrusion 742 of linking rod 730 is moved into and engaged with groove 366 of locking member 36. Insertion blocks 752 of linking rod 730 push follower plate 482 to move in the unlatching direction along second axis Y and to compress first spring 532 (FIG. 14). The displacement of follower 482 along second axis Y is smaller than the length of each of first and second grooves 492 and 494 and elongated slot 496. Thus, first and second pegs 628 and 632 and pin 510 are not moved when follower plate 482 is moved by linking rod 730. As a result, latch 38 is pressed by stop 12 and retracted. Furthermore, connecting member 498, connecting rod 512, first and second traction members 650, first and second follower elements 660, and operative member 688 are not moved.

Furthermore, first face 382 of latch 38 presses against drive pieces 344 of swaying plate 34 to make first ends 341 of first and second side boards 345 of swaying plate 34 pivot inward to the inner, second position, and limiting block 35 is moved to the releasing position. Specifically, guide groove 356 of limiting block 35 is moved to a position where second, smaller end 353 is aligned with and receives narrower section 365 of guide piece 364 of locking member 36. Namely, locking member 36 is no longer restrained by limiting block 35 but is still held in the upper, unlocking position by protrusion 742 of linking rod 730. Note that first, larger end 352 of guide groove 356 provides a space allowing passage of wider section 369 of guide piece 364 of locking member 36. At this time, actuating plate 614 of switch 612 is pressed by pressing block 526 and forms an open circuit (not conductive).

Figure 16:
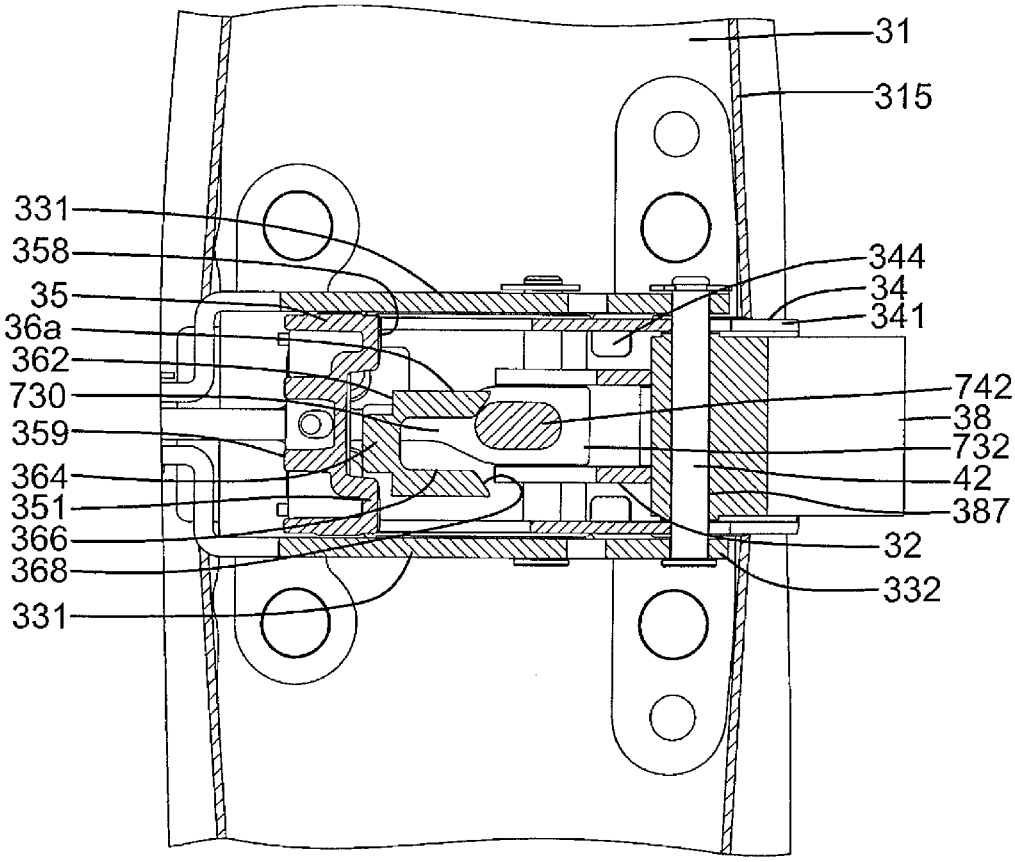
FIG. 16 shows a cross-sectional view taken along section line 16-16 of FIG. 15.
Figure 17:
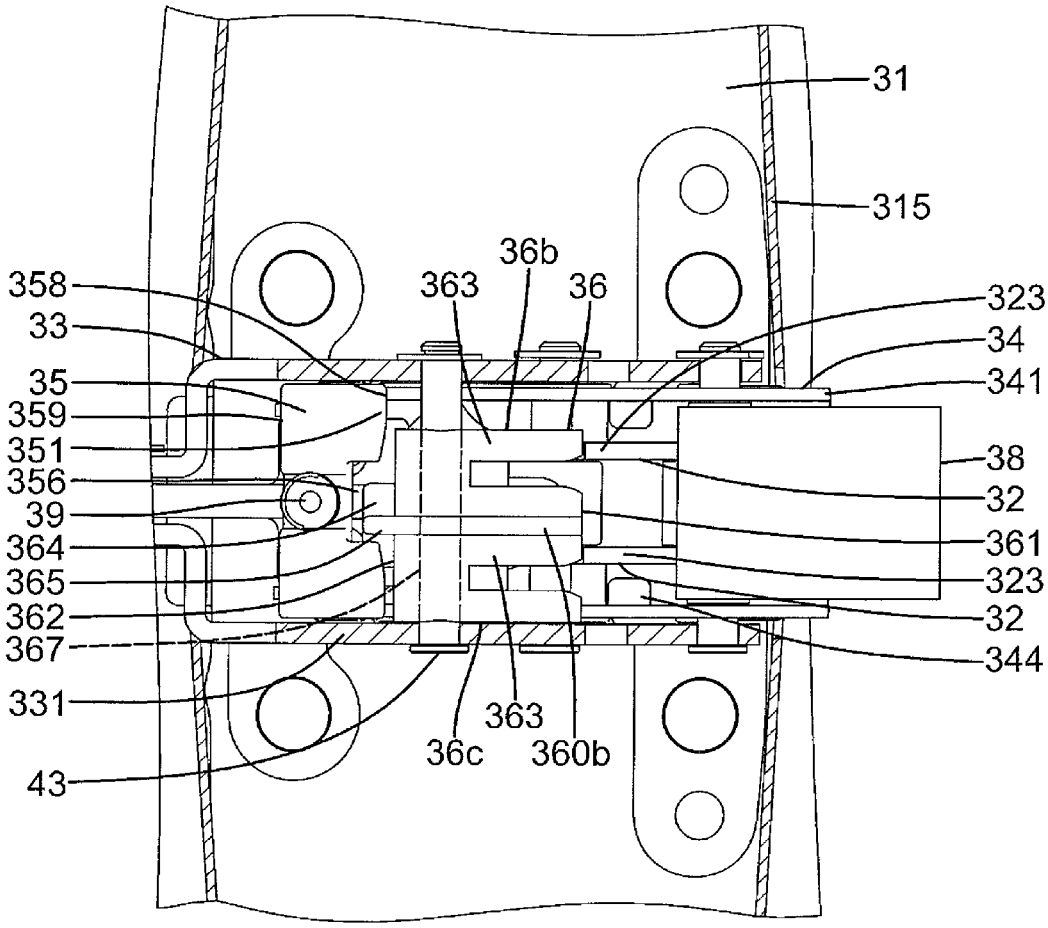
FIG. 17 shows a cross-sectional view taken along section line 17-17 of FIG. 15.

When door 1 is completely closed, first ends 341 of first and second side boards 345 of swaying plate 1 are pressed against and retained in place by stop 12 in the inner, second position. Limiting block 35 is retained in the releasing position. Note that locking member 36 is no longer restrained by limiting block 35, since the second, smaller end 353 of guide groove 356 is aligned with and receives narrower section 365 of guide piece 364 of locking member 36. First spring 532 causes linking rod 730 to move in the latching direction along second axis Y, returning latch 38 to the latching position. Second face 385 of latch 38 presses against stop 12 to lock door 1. Furthermore, linking rod 730 moves in the latching direction toward latch 38, such that protrusion 742 of linking rod 730 disengages from groove 366 of locking member 36. Thus, locking member 36 is released from protrusion 742 and moves downward along guide pin 43 (along first axis X) under the action of gravitational force to the lower, locking position resting on an inner face of second sidewall 331 (FIG. 17). As a result, guide grooves 363 no longer align with extensions 323 of follower 32 (extensions 323 now abut front face 361 of locking member 36). Namely, when door 1 is completely closed, pivotal movement of latch 38 from the extended, latching position to the retracted, unlatching position is prevented, for the follower 32 that pivots together with latch 38 can not pivot inward due to the fact that extensions 323 of follower 32 are not aligned with and, thus, can not pivot into guide grooves 363 of locking member 36. An anti-picking function is, thus, provided. In this case, protrusion 742 of linking rod 730 is not aligned with and outside of groove 366 of locking member 36. Furthermore, protrusion 742 of linking rod 730 abuts against a wall portion of end opening 368 (FIG. 16).

Figure 19:
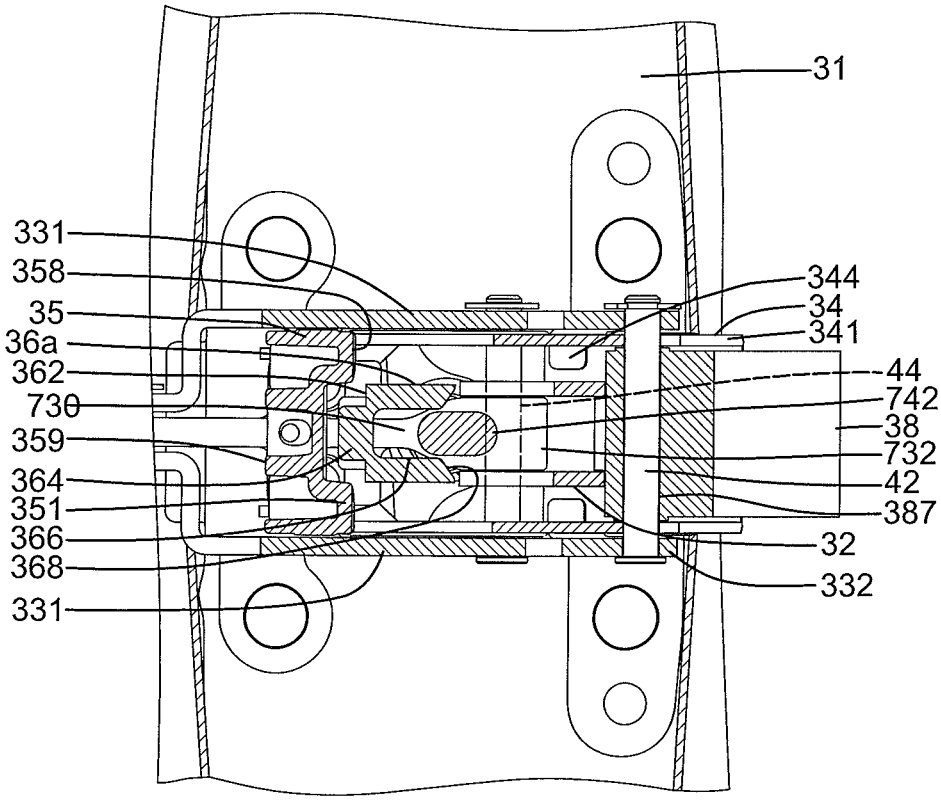
FIG. 19 shows a cross-sectional view taken along section line 19-19 of FIG. 18.

When opening of door 1 is desired, operative member 688 is pressed to an extent to cause pivotal movement of first and second follower elements 660, which, in turn, moves linking rod 730 in the unlocking direction along second axis Y. Specifically, when operative member 688 is pressed, hooks 722 of first and second end caps 708 cause first and second pins 622 and 624 to slide towards connecting plates 562 along sliding slots 564 of first and second brackets 558 along third axis Z. First and second pins 622 and 624 respectively drive first and second traction members 650 to pivot about pivot axes defined by first and second axles 616 and 618. Second corners 656 of first and second traction members 650 respectively push first and second pegs 628 and 632 to slide in the unlatching direction along second axis Y. First and second pegs 628 and 632 cause connecting member 498 and connecting rod 512 to move in the unlatching direction along second axis Y. During movement of connecting member 498, second spring 534 urges sleeve 508 to move, causing movement of pin 510 that abuts an end wall of second groove 494, which, in turn, causes follower plate 482 to move in the unlatching direction along second axis Y. Follower plate 482 draws linking rod 730 to move in the unlatching direction along second axis Y. Linking rod 730 moves through its idle travel equal to the length of slot 744 without moving limiting pin 44 and follower 32 (FIGS. 14A and 18). During the idle travel of linking rod 730, protrusion 742 of linking rod 730 moves through end opening 368 into groove 366 of locking member 36 (FIG. 19) and moves locking member 36 upward along guide pin 43 to the upper, unlocking position so that guide grooves 363 of locking member 36 are aligned with extensions 323 of follower 32 (see FIG. 9). Note that limiting pin 44 is now in front end 746 of slot 744 of linking rod 730. When operative member 688 is further pressed, linking rod 730 moves further in the unlatching direction to move limiting pin 44 in the unlatching direction. As a result, latch 38 pivots together with follower 32 to the retracted, unlatching position allowing opening of door 1 (FIGS. 20 and 21). At the same time, when latch 38 is in the retracted, unlatching position, first and second walls 692 of body 690 of operative member 688 abut pads 557 of mounting plate 548.

When door 1 is in the closed state, door lock 2 can be switched to the locking state (by such as using a remote control). Driving member 636 of driving device 634 moves in the latching direction along second axis Y under action of electromagnetic force. Draw bar 640 is moved from the extended position (FIG. 1) to the retracted position (FIG. 22). Draw bar 640 moves connecting element 649, causing second peg 632 to press against an end face of notch 680 of stop member 668 and to pivot stop member 668 about the pivot axis defined by third axle 620 until stop block 686 of stop member 668 abuts against stop 490 of follower plate 482 (FIG. 22). Thus, follower plate 482 and linking rod 730 can not move in the unlatching direction along second axis Y, preventing latch 38 from pivoting to the unlatching position. Furthermore, burglarproof system 756 can be activated while door lock 2 is in the locking state. In this case, pressing block 526 presses against actuating plate 614 of switch 612, such that switch 612 is not conductive and, thus, will not trigger the burglarproof system 756.

Figure 23:
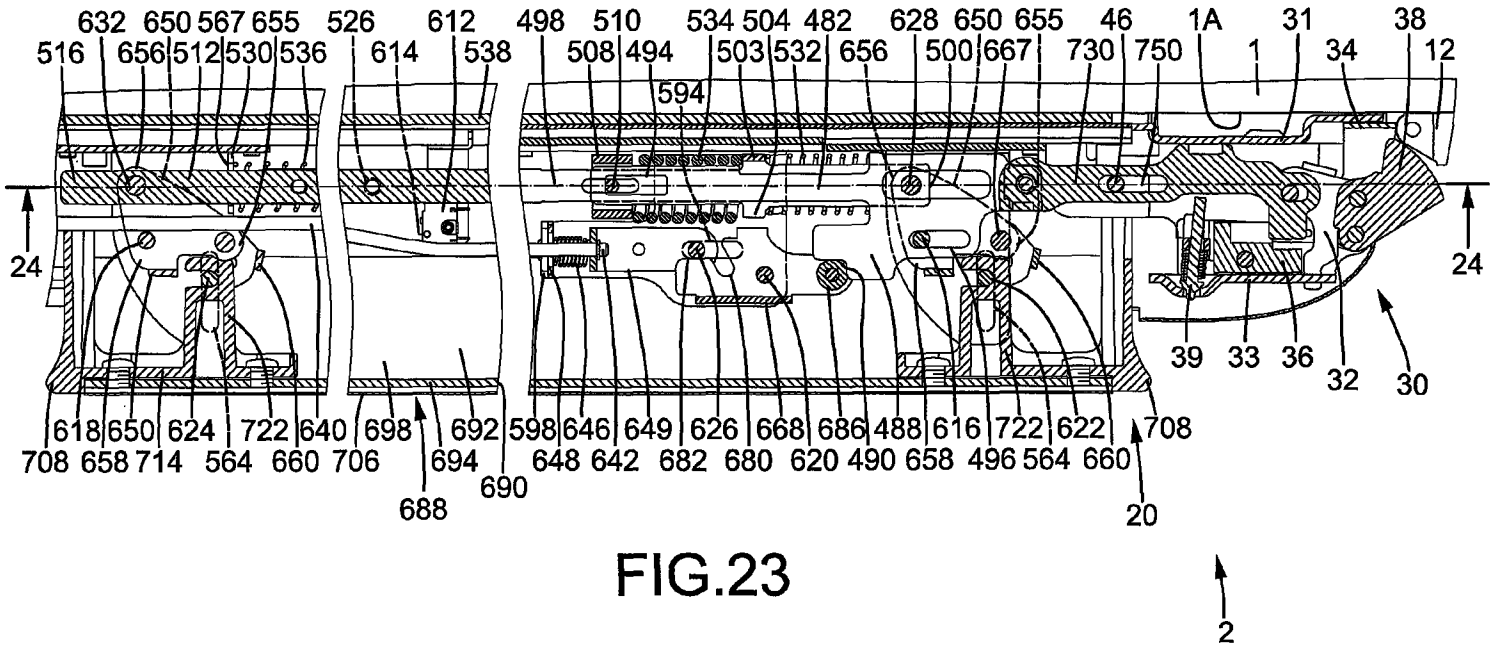
FIG. 23 shows a view similar to FIG. 22, with the operative member pressed to retract the latch.
Figure 24:
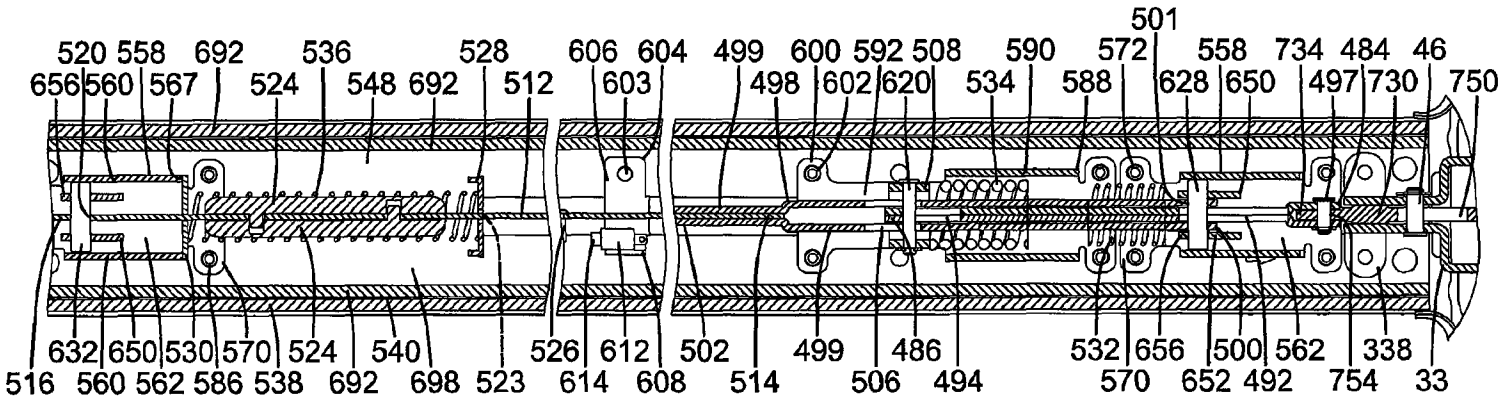
FIG. 24 shows a cross-sectional view taken along section line 24-24 of FIG. 23.

When door 1 is in the closed state and draw bar 640 is in the retracted position (FIG. 22), if operative member 688 is pressed (such as along third axis Z), operative member 688 causes first and second pins 622 and 624 to drive first and second traction members 650 to pivot about pivot axes defined by first and second axles 616 and 618, such that first and second pegs 628 and 632 cause connecting member 498 and connecting rod 512 to move in the unlatching direction along second axis Y. At this time, movement of follower plate 482 in the unlatching direction along second axis Y is stopped by stop block 686 of stop member 668. Due to the position of pin 510 stopped by the end wall of second groove 494, movement of sleeve 508 in the unlatching direction along second axis Y is also stopped (FIGS. 23 and 24). Thus, connecting member 498 and connecting rod 512 move idly along second axis Y without moving follower plate 482. Furthermore, first groove 492 of follower plate 482 provides sufficient room for joint movement of first peg 628 with connecting rod 512 without moving follower plate 482. During displacement of connecting rod 512, pressing block 526 disengages from actuating plate 614 of switch 612, such that switch 612 becomes conductive and activates the burglarproof system 756. Displacement of connecting rod 512 also causes compression of second spring 534 by connecting plate 503 and protrusions 504. Protrusions 523 of connecting rod 512 push first stop board 528 to compress third spring 536. Thus, a resilient buffering effect is provided while operative member 688 is pressed. Furthermore, since follower plate 482 does not move in the unlatching direction along second axis Y, latch 38 will not pivot from the latching position to the unlatching position. Thus, when in the locking state, latch 38 will not retract when operative member 688 is pressed. When operative member 688 is released, second spring 534 returns connecting member 498, and third spring 536 returns connecting rod 512.

By providing connecting member 498 and connecting rod 512 movable relative to follower plate 482, when door lock 2 is in the locking state, operative member 688 can still be pressed through an idle travel without unlatching latch 38 through the idle travel of connecting member 498 and connecting rod 512. Second and third springs 534 and 536 provide a buffering effect when operative member 688 is pressed while door lock 2 is in the locking state, avoiding damage to the components of operative device 20.

Furthermore, hooks 722 on first and second end caps 708 of operative member 688 reduces the time for assemblage of operative member 688. Further, operative member 688 is comprised of fewer components to reduce to manufacturing costs. Further, insertion grooves 724 of operative member 688 extend in a direction parallel to the unlatching direction along second axis Y, such that first and second pins 622 and 624 can be reliably actuated when decorative plate 706 of operative member 688 is pressed without the risk of unreliable actuation and skew movement of operative member 688.

Further, through engagement of connecting pin 497 of operative device 20 and linking rod 730 of latch device 30, fast and separate repair or maintenance of operative device 20 and latch device 30 can be achieved. Specifically, since insertion blocks 752 of linking rod 730 are removably engaged in insertion grooves 485 of follower plate 482, operative device 20 and latch device 30 can be disengaged from each other after removal of connecting pin 497, allowing fast and separate repair or maintenance of operative device 20 and latch device 30.

Now that the basic teachings of the present invention have been explained, many extensions and variations will be obvious to one having ordinary skill in the art. For example, latch device 30 does not have to include swaying plate 34, limiting block 35, locking member 36, guide rod 39, and spring 393. Follower 32 does not have to include extensions 323. Door lock 2 does not have to include casing 538 and mounting plate 548. In this case, first, second, and third brackets 558 and 588 can be directly mounted to first side 1A of door 1, and operative member 688 can be mounted to first and second pins 622 and 624. Further, door lock 2 does not have to include connecting element 649, third pin 626, and movement slots 594 of third bracket 588. When door lock 2 does not include connecting member 649, head 642 of draw bar 640 can be directly coupled to stop member 668. When draw bar 640 is in the extended or retracted position, stop member 668 can be controlled to abut or disengage from stop 490 of follower plate 482 to control door lock 2 in the locking or unlocking state. Further, door lock 2 does not have to include fixing plate 604 and switch 612. In this case, door lock 2 can not be electrically connected to burglarproof system 756. However, when door lock 2 is in the locking state, detection of pressing of operative member 688 can be done to generate an alarm message while other functions of door lock 2 remains unaffected.

Furthermore, each of first and second brackets 558 can include only one plate 560, and third bracket 588 can include only one wall 590. Connecting member 498 can include only one plate 499.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door lock comprising:

a bracket adapted to be fixed to a side of a door, with the door adapted to be pivotably mounted to a door frame having a stop;

a latch mounted to the bracket and pivotable about a first axis between an extended, latching position, and a retracted, unlatching position;

a follower including a first end pivotably connected to the latch and a second end spaced from the first end of the follower along a second axis perpendicular to the first axis;

a linking rod including first and second ends spaced along the second axis, with the first end of the linking rod pivotably connected to the second end of the follower, with the second end of the linking rod movable in an unlatching direction along the second axis for moving the latch from the extended, latching position, to the retracted, unlatching position, and movable in a latching direction opposite to the unlatching direction for moving the latch from the retracted, unlatching position, to the extended, latching position;

first and second brackets adapted to be fixed to the side of the door, with each of the first and second brackets including a sliding slot extending along a third axis perpendicular to the first and second axes, with the second bracket having a spacing to the bracket along the second axis larger than the first bracket;

a third bracket adapted to be fixed to the side of the door and located between the first and second brackets along the second axis;

first and second traction members each including first, second, and third corners, with the third corner of the first traction member pivotably connected to the first bracket by a first axle about a first pivot axis parallel to a pivot axis of the latch, with the third corner of the second traction member pivotably connected to the second bracket by a second axle about a second pivot axis parallel to the first pivot axis;

first and second follower elements each including first and second pivotal portions, with the first pivotal portion of the first follower element pivotably connected to the first corner of the first traction member, with the first pivotal portion of the second follower element pivotably connected to the first corner of the second traction member, with a first pin extending through the sliding slot of the first bracket and the second pivotal portion of the first follower element and defining a third pivot axis parallel to the first pivot axis, with a second pin extending through the sliding slot of the second bracket and the second pivotal portion of the second follower element and defining a fourth axis parallel to the first pivot axis, with the first follower element driving the first traction member to pivot about the first pivot axis when the first pin moves in the sliding slot of the first bracket along the third axis, with the second follower element driving the second traction member to pivot about the second pivot axis when the second pin moves in the sliding slot of the second bracket along the third axis, with the first and second pins pivotably connected to an operative member;

a connecting member including first and second ends spaced along the second axis and a push slot between the first and second ends, with the first end of the connecting member pivotably mounted to the second corner of the first traction member, with the connecting member moving along the second axis when the first traction member pivots about the first pivot axis;

a follower plate including front and rear ends spaced along the second axis and first and second grooves between the front and rear ends, with the first groove located between the second groove and the front end, with the second groove located between the first groove and the rear end, with the follower plate further including an extension extending from an edge of the follower plate and located between the front and rear ends, with a stop formed on the extension, with the extension including an elongated slot spaced from the first groove along the third axis, with the front end of the follower plate removably engaged with the second end of the linking rod, with the follower plate mounted to the connecting member, with the second groove of the follower plate aligned with the push slot of the connecting member, with the connecting member slideable relative to the follower plate along the second axis, with a peg extending through the first groove of the follower plate, with the first axle slideably extending through the elongated slot of the extension;

a sleeve mounted around the connecting member;

a pin extending through the push slot of the connecting member, the second groove of the follower plate, and the sleeve, with the peg pushing the connecting member to slide along the second axis when the first traction member pivots about the first pivot axis;

a connecting rod fixed to the second end of the connecting member, with the connecting rod including a connecting end and a pull end spaced from the connecting end along the second axis, with the connecting end of the connecting rod fixed to the second end of the connecting member, with the pull end of the connecting rod pivotably connected to the second corner of the second traction member, with the connecting rod moving along the second axis when the second traction member pivots about the second pivot axis;

a stop member including first and second ends and a pivot hole between the first and second ends, with the first end of the stop member facing the stop of the follower plate, with a third axle extending through the third bracket and the pivot hole of the stop member and defining a fifth pivot axis parallel to the first pivot axis, with the stop member pivotable about the fifth pivot axis; and a draw bar including a head connected to the second end of the stop member, with the draw bar operable to move along the second axis between an extended position and a retracted position, wherein when in the retracted position, the draw bar has a spacing to the latch larger than that in the extended position, wherein when the draw bar is in the extended position, the first end of the stop member is spaced from the stop of the follower plate, wherein when the draw bar is moved from the extended position to the retracted position, the stop member pivots about the fifth pivot axis to abut the first end of the stop member against the stop of the follower plate, wherein when the draw bar is in the extended position and when the operative member is operated to move the first and second pins along the third axis towards the door, the first and second follower elements pivot the first and second traction members about the first and second pivot axes, wherein when the second corners of the first and second traction members move the connecting member and the connecting rod in the unlatching direction, the connecting member causes the pin to push and move the follower plate in the unlatching direction along the second axis, wherein the connecting rod causes the linking rod to move in the unlatching direction along the second axis, moving the latch from the extended, latching position, to the retracted, unlatching position, wherein when the draw bar is in the retracted position and when the operative member is operated to move the first and second pins along the third axis towards the door, the first and second follower elements pivot the first and second traction members about the first and second pivot axes, wherein when the second corners of the first and second traction members move the connecting member and the connecting rod in the unlatching direction, movement of the follower plate in the unlatching direction is stopped by the first end of the stop member, wherein the first groove of the follower plate allows movement of the peg in the unlatching direction without moving the follower plate, wherein the push slot of the connecting member allows movement of the connecting member in the unlatching direction without moving the pin, preventing movement of the linking rod in the unlatching direction, and wherein the latch remains in the extended, latching position, wherein when the draw bar is in the extended position and when the latch is pressed against the stop on the door frame and pivoted from the extended, latching position, to the retracted, unlatching position, the latch moves the follower element in the unlatching direction to move the linking rod in the unlatching direction, the linking rod causes the follower plate to move in the unlatching direction, the peg received in the first groove of the follower plate and the pin received in the second groove of the follower plate are not moved, and the elongated slot of the follower plate allows movement of the follower plate relative to the third corner of the first traction member without pivoting the first traction member about the first pivot axis and without moving the first axle.

2. The door lock as claimed in claim 1, with the front end of the follower plate including an insertion groove, with the second end of the linking rod including an insertion block, with the insertion block releasably engaged in the insertion groove, and with a connecting pin extending through the front end of the follower plate and the second end of the linking rod, allowing joint movement of the follower plate and the linking rod.

3. The door lock as claimed in claim 1, with the connecting member further including a protrusion located between the push slot and the first end of the connecting member, with the protrusion including first and second sides, with the door lock further comprising:

a first spring mounted around the follower plate and having an end abutting the first side of the protrusion of the connecting member; and a second spring mounted around the connecting member and having a first end abutting the second side of the protrusion, with the second spring further including a second end abutting an end face of the sleeve, with the second spring biasing the sleeve to press the pin against an end wall of the second groove, wherein when the draw bar is in the retracted position and when the operative member is operated to move the first and second pins along the third axis towards the door, the connecting member moves in the unlatching direction along the second axis, the protrusion and the connecting member compress the second spring without moving the sleeve and the pin, the follower plate does not move in the unlatching direction along the second axis, and the second spring returns the connecting member in the latching direction along the second axis when the operative member is released, wherein when the draw bar is in the extended position and when the latch is pressed against the stop on the door frame and pivoted from the extended, latching position, to the retracted, unlatching position while moving the door from an open position to a closed position, the first spring is compressed by the follower plate and the protrusion of the connecting member, and wherein when the door reaches the closed position and the latch (38) is in the retracted, unlatching position, the first spring returns the follower plate in the latching direction along the second axis, which, in turn, returns the linking rod in the latching direction along the second axis move the latch to the extended, latching position.

4. The door lock as claimed in claim 3, with the connecting rod including a protrusion located between the connecting end and the pull end, with the door lock further comprising:

a third spring mounted around the connecting rod and having first and second ends;

a first stop board mounted on the connecting rod and abutting the protrusion, with the first end of the third spring abutting the first stop board; and a second stop board mounted around the connecting rod and abutting the second bracket, with the second end of the third spring abutting the second stop board, wherein when the operative member is operated to move the first and second pins along the third axis towards the door, the protrusion of the connecting rod pushes the first stop board to move in the unlatching direction along the second axis and compresses the third spring, and wherein when the operative member is released, the third spring causes the first stop board and the connecting rod to move in the latching direction along the second axis, returning the operative member and returning the latch to the extended, latching position.

5. The door lock as claimed in claim 3, with the operative member including:

a body including first and second end faces spaced along the second axis, with the body defining a space extending from the first end face through the second end face, with the space having an opening; and first and second end caps mounted to the body and each including a first portion extending along the third axis and having a sidewall, with each of the first and second end caps further including a second portion extending from the sidewall along the second axis, with the second portion of each of the first and second end caps including top and bottom faces spaced along the third axis, with a hook extending from the bottom face of each of the first and second end caps and including an insertion groove facing the latch, with the second portions of the first and second end caps received in the space of the body, with the sidewalls of the first portions abutting the first and second end faces, with the first and second pins respectively received in the insertion grooves of the first and second end caps, wherein when the operative member is operated, the hooks of the first and second end caps push the first and second pins to move along the third axis towards the door.

6. The door lock as claimed in claim 1, further comprising: a driving device mounted to the side of the door, with the draw bar further including a tail spaced from the head along the second axis, with the tail fixed to the driving device to move therewith, with the draw bar located in the extended position when the driving device is not electrified, with the draw bar in the retracted position when the driving device is electrified, with a pressing block fixed to the connecting rod and located between the pull end of the connecting rod and the second end of the connecting member, with a switch fixed relative to the door and including an actuating plate, with the pressing block pressing against the actuating plate, with the pressing block disengaged from the actuating plate when the operative member is operated to move the connecting rod in the unlatching direction along the second axis, with the switch electrically connected to a burglarproof system, wherein when the draw bar is in the retracted position and when the pressing block is pressing against the actuating plate, the switch is not conductive, and the burglarproof system is not triggered, and wherein when the drawbar is in the retracted position and when the pressing block does not press against the actuating plate, the switch is conductive and triggers the burglarproof system to generate an alarm message.

* * * * *